US011528982B2

(12) United States Patent
Li et al.

(10) Patent No.: US 11,528,982 B2
(45) Date of Patent: Dec. 20, 2022

(54) PADDED SLING SYSTEMS

(71) Applicant: Vista Outdoor Operations LLC, Anoka, MN (US)

(72) Inventors: Raymon Li, Guang Zhou (CN); William Hemeyer, Overland Park, KS (US); Monte N. Koenigs, Overland Park, KS (US); Jeremy Manning, Overland Park, KS (US)

(73) Assignee: VISTA OUTDOOR OPERATIONS LLC, Anoka, MN (US)

( * ) Notice: Subject to any disclaimer, the term of this patent is extended or adjusted under 35 U.S.C. 154(b) by 0 days.

(21) Appl. No.: 17/138,401

(22) Filed: Dec. 30, 2020

(65) Prior Publication Data

US 2021/0112951 A1 Apr. 22, 2021

Related U.S. Application Data

(63) Continuation-in-part of application No. 16/731,932, filed on Dec. 31, 2019, now abandoned.

(Continued)

(51) Int. Cl.
*A45F 3/04* (2006.01)
*A45F 3/12* (2006.01)

(Continued)

(52) U.S. Cl.
CPC ..... *A45F 3/047* (2013.01); *A45F 3/12* (2013.01); *A45F 3/14* (2013.01);

(Continued)

(58) Field of Classification Search
CPC ..... F41C 33/002; A45F 3/047; A45F 3/12; A45F 3/14

(Continued)

(56) References Cited

U.S. PATENT DOCUMENTS 4,525,875 A * 7/1985 Tomczak ..... A41D 13/0518 2/466
5,131,576 A * 7/1992 Turnipseed ..... A45F 3/08 224/907

(Continued)

FOREIGN PATENT DOCUMENTS

CN 206025282 U * 3/2017

OTHER PUBLICATIONS

"CN 206025282-U; Pang, Wuyi; Cloth, has riding protective clothing impact pad and connection device formed with air bag, where air bag and riding protective clothing impact pad that are for providing protection to human body key part; Mar. 22, 2017" (Year: 2017).*

(Continued)

*Primary Examiner* — Nathan J Newhouse
*Assistant Examiner* — Lester L Vanterpool
(74) *Attorney, Agent, or Firm* — Walter M. Egbert, III; Richard J. Brown; Reed Smith LLP

(57) ABSTRACT

A sling for a firearm or luggage is provided comprising a pad comprising a single layer closed cell foam body defining a first surface and a second surface and a plurality of slots extending therethrough from the upper surface to the lower surface; and a binding secured to the periphery of the pad. The pad can be configured in a variety of ways to provide slings for carrying firearms and luggage. An embodiment of the pad is a backpanel having four sides and four corners that can be releasably connected to a chest pack such as a binocular case.

16 Claims, 18 Drawing Sheets

Related U.S. Application Data

(60) Provisional application No. 62/895,378, filed on Sep. 3, 2019.

(51) Int. Cl.
*A45F 3/14* (2006.01)
*A45F 3/00* (2006.01)

(52) U.S. Cl.
CPC ... *A45F 2003/003* (2013.01); *A45F 2003/122* (2013.01); *A45F 2003/142* (2013.01); *A45F 2200/0533* (2013.01); *A45F 2200/0591* (2013.01)

(58) Field of Classification Search
USPC ..... 224/150, 623, 259
See application file for complete search history.

(56) References Cited

U.S. PATENT DOCUMENTS

D435,169 S * 12/2000 Carver ..... D3/226
7,036,943 B1 * 5/2006 Brewer ..... A45F 5/00 224/637
8,132,669 B1 3/2012 Stubel
8,720,681 B1 * 5/2014 Hancock ..... A45C 13/1069 224/183
8,925,774 B2 * 1/2015 Mori ..... A45F 3/14 224/261
9,332,822 B2 * 5/2016 Hunt ..... A45F 5/14
D776,423 S * 1/2017 Zhou ..... D24/190
9,861,183 B2 * 1/2018 Hunt ..... A45F 3/047
9,872,553 B1 * 1/2018 Erlandson ..... A45C 11/08
10,299,572 B2 * 5/2019 Salentine ..... A45F 5/021
D851,919 S * 6/2019 Lee ..... D3/217
2003/0015561 A1 * 1/2003 Enes ..... A63B 55/408 224/260
2012/0037675 A1 * 2/2012 Shepherd ..... A45C 3/00 224/259
2012/0248161 A1 * 10/2012 Chauhan ..... A45F 3/12 224/264
2013/0233661 A1 * 9/2013 Scott ..... A45F 3/047 190/102
2015/0068933 A1 * 3/2015 So ..... A45C 11/38 150/112
2017/0143089 A1 * 5/2017 Kim ..... A45C 13/10
2018/0020791 A1 * 1/2018 Cole ..... A45C 13/103 224/576

OTHER PUBLICATIONS

Website: https://www.badlandsgear.com/products/bino-d-mag?variant=16292670406705; Dec. 29, 2020.
Website: https://www.badlandsgear.com/products/bino-xr; Dec. 29, 2020.
Website: https://eberlestock.com/products/scout-bino-pack-small; Dec. 29, 2020.
Website: https://homhunterpacks.com/product/op-x-combo-bino-harness-system/; Dec. 29, 2020.
Website: https://www.mysteryranch.com/quick-draw-binocular-harness; Dec. 29, 2020.

* cited by examiner

PADDED SLING SYSTEMS

CROSS-REFERENCE TO RELATED APPLICATIONS

This application claims priority to U.S. Provisional Application No. 62/895,378, filed Sep. 3, 2019, entitled "Firearm Sling" and U.S. Utility application Ser. No. 16/731,932, filed Dec. 31, 2019, entitled "Firearm Sling," both of which are incorporated by reference in their entirety herein.

FIELD OF THE DISCLOSURE

The present disclosure relates to firearm and luggage accessories, more particularly to lightweight, multi-functional slings and straps.

DESCRIPTION OF RELATED ART

Carrying straps or slings have long been used to carry firearms and various articles of luggage. Advantageously, such slings reduce fatigue and increase the utility of the firearm or luggage over hand-carrying, by providing support while leaving the wearer's hands free for other tasks. Carrying straps or slings are typically constructed of leather or webbing made of cloth or nylon attached to the firearm or luggage by the use of various hooks or buckles.

Due to weight of the firearm or luggage being carried, a support pad is typically provided on the strap to increase the comfort of the wearer. Such support pads provide cushioning to alleviate the pressure of the strap directly on the shoulder of the wearer.

Conventional support pads suffer from several flaws. Such pads typically include several layers of material, including an inner cushioning material and outer fabric layers, and thus can be bulky, unsightly, and add additional weight to the sling. Moreover, the increased size of the support pad can provide an area for trapping heat generated by the wearer which cause undesired perspiration and discomfort. The outer fabric layers may also be slippery and provide an insecure mount on the shoulder during use.

Accordingly, there is a need for an improved sling system for a firearm and luggage that provides a wearer with comfort, breathability and security, without adding increased weight or bulk.

SUMMARY

Provided is a back panel for a sling system, comprising a pad comprising a single layer closed cell foam body defining a first surface and a second surface and a plurality of slots extending therethrough from the first surface to the second surface, wherein the pad is configured generally as a quadrilateral shape with four corners comprising two upper corners and two lower corners and four sides optionally having concave curvature; a binding secured to the periphery of the pad;

and four strap portions, each strap portion connected to the pad at one of the four corners, each strap portion comprising a coupling mechanism for connecting the back panel to an article.

In some embodiments, the foam body is an ethylene-vinyl acetate copolymer.

In some embodiments, the first and second surfaces of the pad are exposed.

In an embodiment, the back panel is connected to a pack to be worn proximate to a user's chest, wherein the back panel is connected to the pack via the coupling mechanisms, wherein each coupling mechanism is independently connected to a different locus on the pack.

The disclosure also provides a pack to be worn proximate to a user's chest, comprising:

two strap portions at the top of the pack and two strap portions at the bottom of the pack; and a back panel to be worn proximate to a user's back comprising a pad comprising a single layer closed cell foam body defining a first surface and a second surface and a plurality of slots extending therethrough from the first surface to the second surface; and a binding secured to the periphery of the pad, wherein the pad configured generally as a quadrilateral shape with four corners comprising two upper corners and two lower corners and four sides optionally having concave curvature; and four strap portions, each strap portion connected to the pad at one of the four corners, each strap portion comprising a coupling mechanism; wherein the two strap portions at the top of the pack are independently attached to two strap portions connected to the back panel at one of the two upper corners of the back panel and the two strap portions at the lower portion of the pack are independently attached to two strap portions connected to the back panel at one of the two lower corners of the back panel.

In embodiments, the pack comprises a case for an optical device selected from a binocular, monocular, range finder, camera, lens or any combination thereof.

Embodiments of the pack or case include the following, alone or in any combination:

The case comprising a compartment for holding an optical device, the compartment comprising a bottom wall, top wall, back wall, front wall and opposing side walls wherein the edges of the top wall, front wall and side walls define an opening into the compartment, and a cover flap configured to overlap at least a portion of each of the top and side walls hingedly attached to a hinge area at the edge of the front wall to completely enclose the optical device when closed and rotatable forwardly at the hinge area to expose the opening to access the optical device.

The cover flap comprising a magnet or plurality of magnets to automatically engage complementary ferromagnetic magnet(s) on the top and side walls to cover the opening.

The cover flap comprising a loop to facilitate efficient one handed opening.

The body of the case comprising suede cloth and optional padding on one or more of the walls and cover flap.

Two strap portions at the top of the case are independently attached to two strap portions connected to the back panel at one of the two upper corners of the back panel, preferably wherein the two strap portions at the top of the case comprise a length adjustment mechanism.

The two strap portions at the top of the case comprise female components of side release buckles and are connected to strap portions of the back panel comprising male components of the side release buckles.

Two strap portions at the lower portion of the case are independently attached to two strap portions connected to the pad at one of the two lower corners of the back panel, preferably wherein the two strap portions at the lower portion of the case comprise a length adjustment mechanism.

The two strap portions at the top of the case comprise female components of side release buckles and are connected to strap portions of the back panel comprising male components of the side release buckles.

The case comprising one or more tethers inside the compartment, to attach the optical device to the case.

The case comprising an interior mesh pocket, optionally with a closure such as a zipper.

The case comprising webbing on the front and/or side walls and/or D-loops to attach accessories to the exterior of the case.

The case comprising a mesh pocket on one or both of the side walls.

The case wherein the back wall comprise an airmesh surface.

The case wherein the back wall comprises an exterior compartment with a zipper closure.

The case wherein the compartment is sized to contain a 10×42 roof prism binocular.

BRIEF DESCRIPTION OF THE FIGURES

Features and advantages of the claimed subject matter will be apparent from the following detailed description of embodiments consistent therewith, which description should be considered with reference to the accompanying drawings, wherein:

For ease of presentation, like reference numbers in the Figures refer to elements or components having the same function, even if they are not identically configured, shaped or dimensioned.

DETAILED DESCRIPTION OF EXEMPLARY EMBODIMENTS

The disclosed subject matter generally relates to an improved sling system. While an exemplary embodiment of the sling is described in detail below in conjunction with a firearm, the sling described herein may also be applied to a broad variety of apparatuses such as luggage, including slings, straps and belts for various pieces of luggage such as duffels, satchels, shoulder bags, musette bags, backpacks, front or chest packs, hip packs and hip belts, binocular cases, sports equipment bags such as golf bags, racket bags, bags for football, softball or baseball equipment, equipment bags or cases, such as for binoculars, range finders, cameras and/or camera lenses, etc.

As used herein, the term "attachment point" refers to a locus for attaching the pad portion of the sling system to an article such as a firearm or luggage to be carried by the sling or to an additional component of the sling system. Attachment points may include direct, fixed attachment of the pad portion to the article by for example, sewing, gluing, stapling or other fastening method, or indirectly through one or more of straps, buckles, clips, snaps, buttons, b-rings, hangers, other connectors, or combinations thereof, either removably or fixedly.

As used herein, the terms "top," "upper", "bottom," "lower", "front," "back," and the like refer to a direction or position on the sling system related to a user standing erect wearing the sling system.

A firearm or luggage sling is provided including a first strap portion and a second strap portion, each of the first strap portion and second strap portion including a coupling mechanism, at least one of the first or second strap portions including a length adjustment mechanism; a pad coupled to the first strap portion and the second strap portion, the pad comprising a single layer closed cell foam body defining an upper surface and a lower surface and a plurality of slots extending therethrough from the upper surface to the lower surface; and a binding secured to the periphery of the pad.

Figure 1:
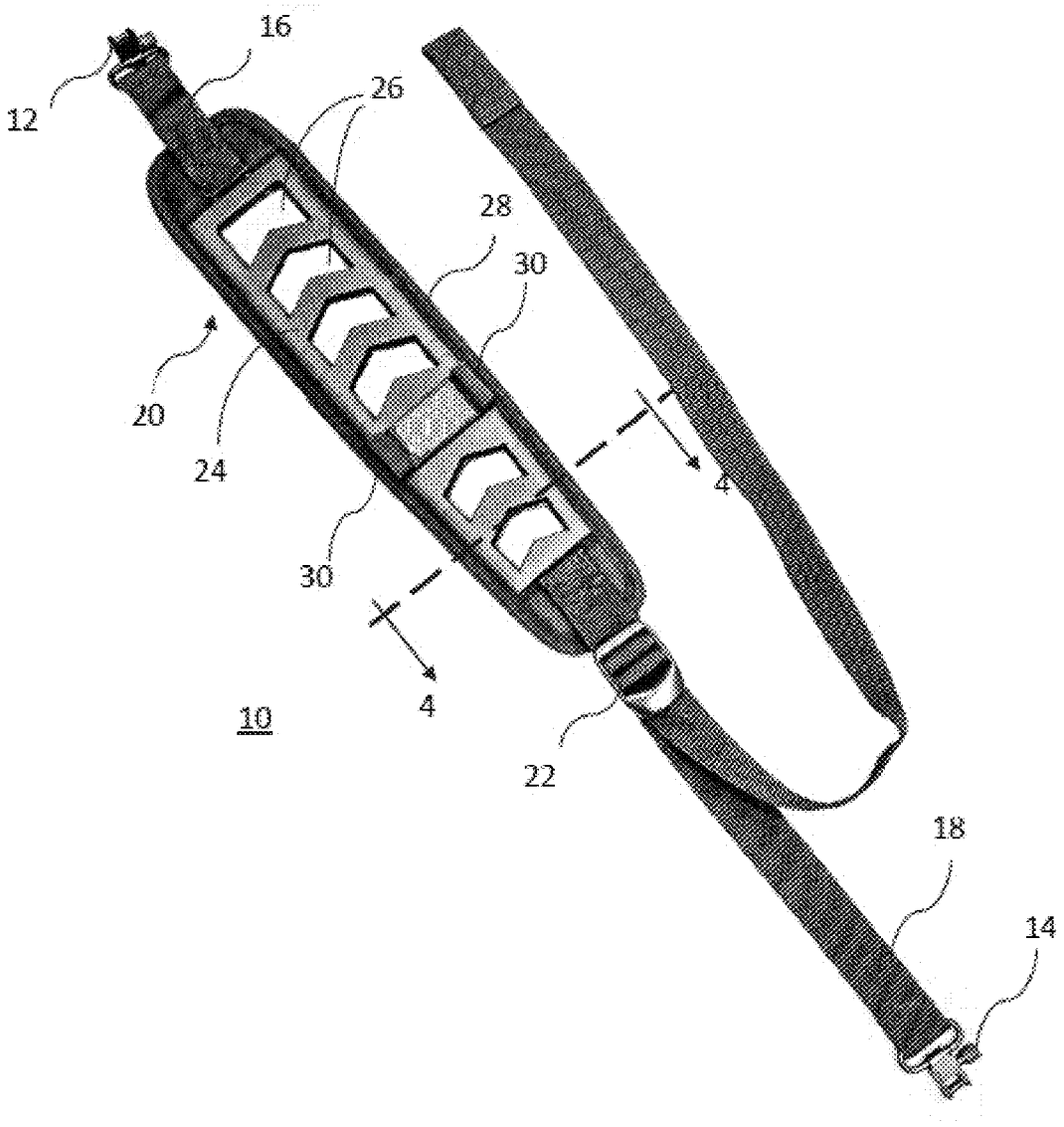
FIG. 1 illustrates a sling, viewed from above, in accordance with an exemplary embodiment of the disclosed subject matter.

One example of the improved sling for a firearm or luggage is illustrated in FIG. 1. Sling 10 includes a first end 12 and second end 14, each configured to be coupled or otherwise affixed to the firearm or luggage with a coupling mechanism, e.g., a detachable locking swivel clip or other similar connector. The sling includes a first strap portion 16 and second strap portion 18 and a pad portion 20 disposed between or coupled to the strap portions 16, 18. In some embodiments, each strap 16 and 18 are sewn directly to pad portion 20. In some embodiments, one or more of the strap portions 16, 18 are adjustable to lengthen or shorten the length of the strap to fit a wearer better. For example, a buckle 22 is provided to allow length adjustment of strap 18. As illustrated in greater detail in FIG. 5, a short strap portion 32 is sewn to the pad portion 20, which supports a buckle 22 that allows for the adjustability of the length of the strap 18. In some embodiments, a strap portion analogous to strap 32 is sewn to the pad portion and supports an additional buckle 22 that allows for the adjustability of the length of the strap 16.

The relative lengths of strap portions 16 and 18 depicted in FIG. 1 are not limiting. For a firearm sling, strap portion 16 may be relatively short compared to strap portion 18 because the sling is configured to carry the firearm proximate to the user's shoulder. For luggage intended to be carried proximate to the user's chest or hip area, strap portion 16 may be longer than that for a firearm sling. In some embodiments, one or both strap portions 16 and 18 are adjustable using buckle(s) 22 for customizing the overall length of the sling to adjust it to users of different sizes.

In some embodiments, the pad portion 20 includes a pad body 24 fabricated from a single layer of closed cell foam material, such as an ethylene-vinyl acetate (EVA) copolymer. The pad portion 20 absorbs vibrations or shock transferred from the firearm or luggage. The pad portion 20 provides a comfortable fit against the wearer's body when wearing the sling 100 and carrying a firearm or luggage. The dimensions of the pad body 24 may be varied, provided the pad body 24 is configured to allow the firearm or luggage to be carried on the user's body and provide sufficient comfort to the user. For example, the dimensions of the pad body may be about 4 to about 10 cm in width, about 15 to about 25 cm or longer in length, and about 0.5 to about 3 cm in thickness.

In some embodiments, the pad body 24 is exposed, such that the foam material is not covered with any further materials, and thus is capable of making contact with the wearer. The exposed foam material provides a frictional surface to reduce slipping of the pad portion 20 on the wearer's shoulder. A textured surface, e.g., small dimples, is provided to the upper surface 36 and the lower surface 38 of the pad body 24 to further reduce slipping and provide additional breathability.

As illustrated in FIGS. 1-4, the pad portion 20 defines one or more slots 26 in the pad body 24. The slots 26 extend from the first, upper surface 36 of the pad body 24 to the second, lower surface 38 thereof. The first surface is the surface of the pad that faces away from a user when using the sling and the second surface paces toward a user when using the sling. The slots 26 are sized and configured to allow air to pass therethrough and to release heat from the wearer's body, and to reduce density and weight of the pad body 24. The slots 26 may be formed in a chevron, rectangular, polygonal, circular, oval or other shape, or combinations thereof.

Figure 4:
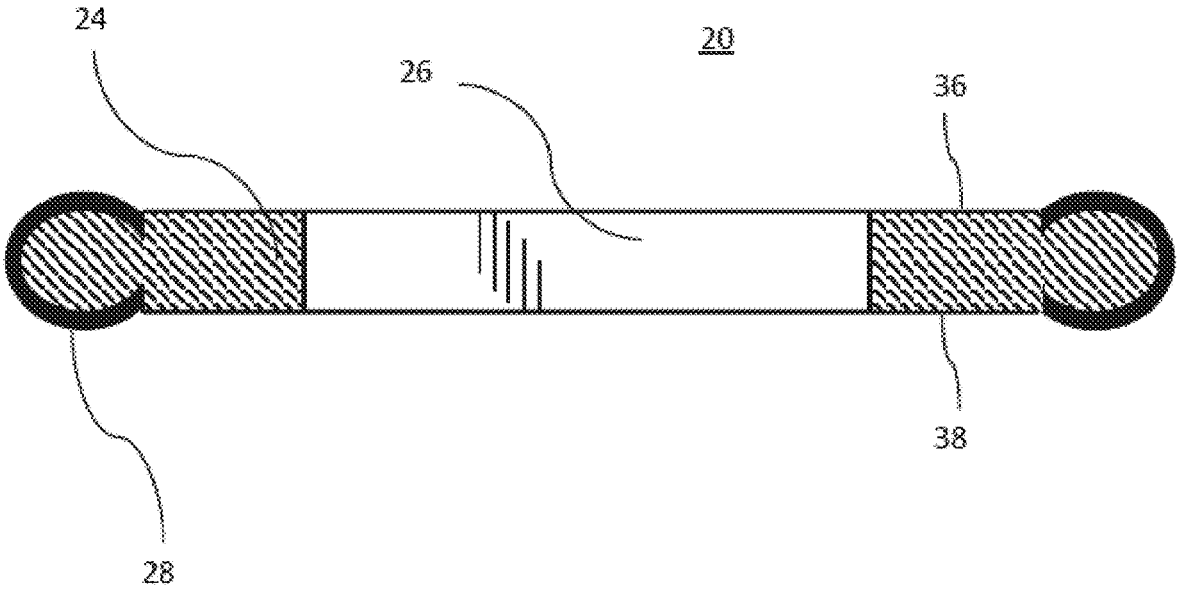
FIG. 4 illustrates a cross-sectional view of the pad portion of the sling, taken from line 4-4 of FIG. 1, in accordance with an exemplary embodiment of the disclosed subject matter.

As illustrated in greater detail in FIG. 4, the pad portion 20 further includes a piping or binding 28 that is secured about the perimeter of the pad body 24. In some embodiments, the binding 28 is stitched to the pad body 24. Alternatively, the binding 28 is glued or stapled to the pad body 24. The binding 28 is fabricated from a durable flexible material such as nylon fabric or the like, and provides additional strength to the pad portion 20.

In some embodiments, at least a portion of the pad body 24 may be overlaid with a fabric cover over the first surface of the sling 10 to provide additional strength, modify its appearance or provide additional functionality. Preferably, the fabric cover is lightweight and comprises a textile that is breathable, or permeable to moisture and air, for managing heat and moisture under the pad. In some embodiments, the fabric cover may be fixedly attached to the sling 10, such as being sewn, glued or stapled into piping or binding 28. In embodiments wherein the sling 10 is used to carry luggage, the fabric cover may comprise fabric that is the same as that used in at least a portion of the body of the luggage. In other embodiments, the fabric cover may be removably attached to the sling 10 with fastener(s) such as clips, snaps, buttons, or hook and loop surfaces (e.g. Velcro®) proximate to first end 12 and/or second end 14. Removable covers may be desirable to modify the appearance of the sling, depending on its intended use. For example, a removable cover may be used selectively to increase a user's visibility, using a vivid color (e.g. blaze orange) and/or reflective materials, or decrease a user's visibility, such as camouflage patterns selected according to the environment in which the sling is to be used.

Figure 3:
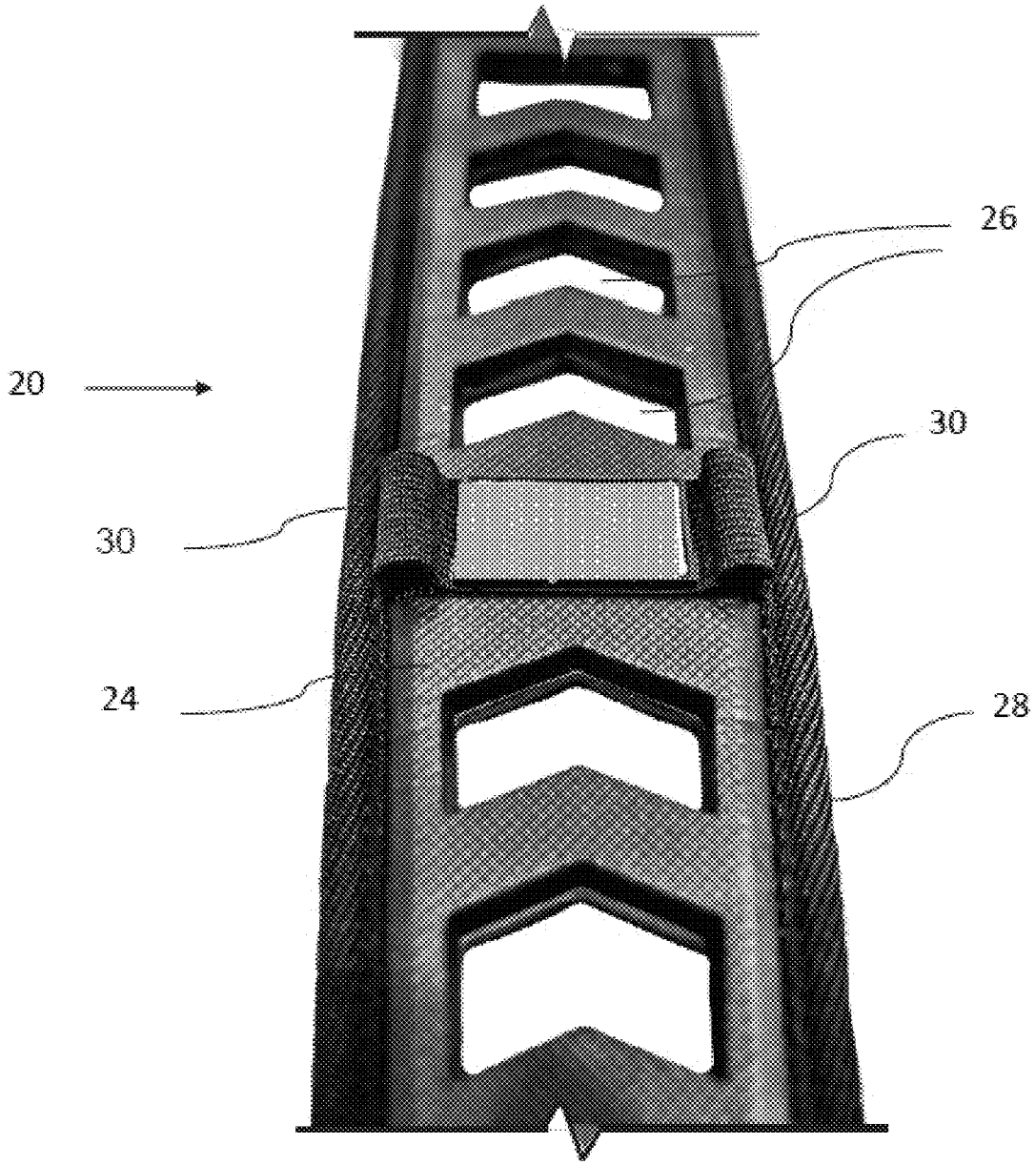
FIG. 3 illustrates a close-up view from above of the pad portion of the sling in accordance with an exemplary embodiment of the disclosed subject matter.

According to another aspect of the disclosure, the sling 10 may include one or more holders 30 configured to hold additional accessories including additional ammunition or cartridges. As illustrated in FIGS. 1 and 3, holders 30 are constructed as a loop from an elasticized fabric to secure the accessories to the pad portion 20.

In some embodiments, the fabric cover described above may comprise additional features such as holders 30, clips, snaps, buttons, loops, hook and loop surfaces, pockets or compartments to hold or attach small items to the sling 10.

Figure 2:
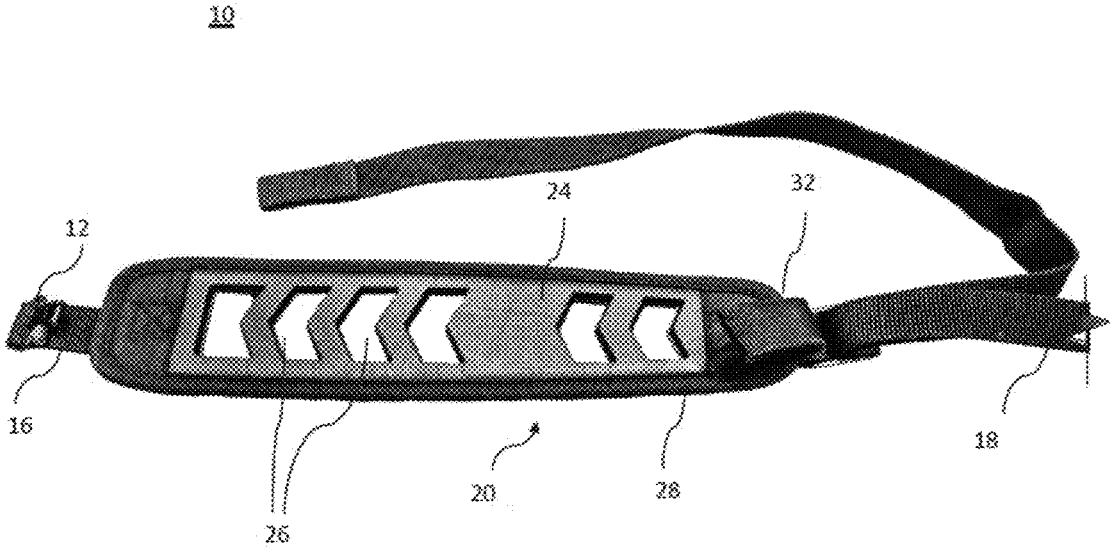
FIG. 2 illustrates the sling of FIG. 1, viewed from below, in accordance with an exemplary embodiment of the disclosed subject matter.
Figure 5:
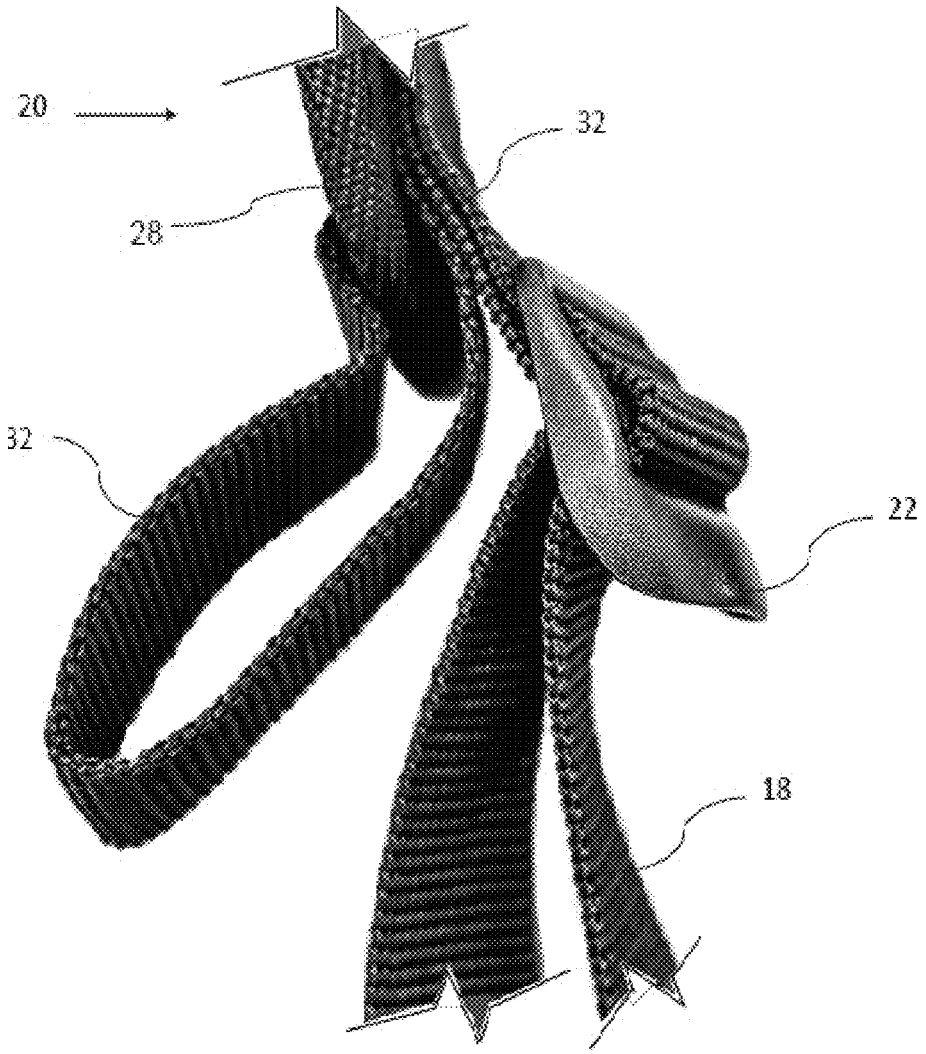
FIG. 5 illustrates an enlarged partial view of the coupling of the strap portion of the sling, along with a thumb loop, in accordance with an exemplary embodiment of the disclosed subject matter.

As illustrated in FIGS. 2 and 5, the strap 18 may also include a built-in thumb loop 32 giving the wearer a convenient manner to maneuvering the sling about the wearer's body. In some embodiments, the thumb loop 32 is fabricated from the same material as the straps 16 and 18, and is sewn to the pad portion 20.

In some embodiments, the first strap portion 16 and second strap portion 18 are connected by an intermediate strap portion and the pad portion 20 is slidably disposed on the intermediate strap portion between the strap portions 16, 18 by one or more sleeve portions attached to opposed sides of the binding 28. For example, the fabric cover described above may function as the sleeve portion. Alternatively, two or more straps fabricated from the same material as the straps 16 and 18 or binding 28 may be attached to the binding 28 so that the pad 20 can slide along the intermediate portion. Strap portions 16, 18 and the intermediate portion may comprise a single, unitary strap. Alternatively, one or both of the strap portions 16 or 18 are adjustably connected to the intermediate strap portion by a buckle 22 attached at respective ends of the intermediate portion analogous to the connection of strap portion 18 to strap portion 32. A slidable pad portion may allow better customization for user fit.

The sling 10 shown in FIGS. 1 through 5 is configured to carry a firearm (e.g. a long gun such as a rifle or shotgun) or article of luggage over one shoulder of a user, either on one side of the user (e.g. proximate to the right shoulder, side and hip of the user) or crossbody (e.g. proximate to the right shoulder and left hip across the body of the user). Thus, sling 10 can be considered as being configured in a one-shoulder, 2-attachment point configuration). Using the sling in this manner, a user would typically carry the article attached thereto over the user's shoulder, proximate to the user's upper back to enable freer movement of the user's arms and hands.

In some embodiments, the sling 10 may be configured to carry a firearm such as a handgun in a shoulder holster wherein the handgun is carried under a user's armpit. In other embodiments, the sling may be configured to carry a firearm in a "ready" position proximate to a user's chest in addition to an over-the-shoulder carry.

One can appreciate that when using sling 10, the user occasionally may need to use one hand to stabilize or adjust the article to a preferred position, thereby limiting full use of that hand. So, it may be desirable to increase mobility and freedom of movement for a user. Further, when carrying heavy and/or bulky articles such as high caliber hunting rifles or large pieces of luggage, using one shoulder may become uncomfortable to the user if the article is carried for an extended period of time (e.g. over 30 minutes). Bulky and/or heavy items may be carried more comfortably in a more balanced manner. Accordingly, sling systems configured to be carried on both of a user's shoulders (a 2-shoulder configuration) are envisioned herein, and in some embodiments, slings of this disclosure may comprise two or more pad portions 20.

In some embodiments, two slings 10 may be attached to a single article to allow a two-shoulder carry. For example, two slings 10 may be attached to a firearm proximate to the firearm's barrel end using two connectors at first ends 12 and attached to a firearm proximate to the firearm's stock using two connectors at second ends 14. Alternatively, strap portions 16 of two slings similar to sling 10 are attached to a single connector at first end 12 for connection to the article and the strap portions 18 of the two slings are attached to two connectors at second ends 14 for attachment to the article (a 3-attachment point configuration). Alternatively, strap portions 16 of two slings similar to sling 10 are attached to a single connector at first ends 12 and the strap portions 18 of the two slings are attached to a single connector at second ends 14 for attachment to the article (a 2-attachment point configuration).

In some embodiments, two slings or straps of the disclosure may omit strap portions 16 and connectors at first ends 12 and the pad portions 20 are attached or connected directly to an article of luggage such as by sewing, and second ends 14 of strap portions 18 are attached to the article either directly such as by sewing or by connectors at 14. Examples of these embodiments include backpacks.

In some embodiments, pad portion 20 is configured to contact a user's body proximate to both shoulders and a portion of the user's back, such as the upper back, and the sling comprises strap portions analogous to strap portions 18 and second end 14 at opposed ends of the pad portion 20. One or more attachment points to attach the sling to an article can be attached to pad portion 20. For example, a sling configured according to this embodiment may comprise an attachment point positioned proximate to the center of the pad portion, i.e. proximate to the center of a user's upper back, for attaching to a firearm. In other embodiments, two attachment points may be positioned on the pad portion proximate to the user's shoulders, such as for attaching to a backpack. In embodiments of these sling configurations, the ends of strap portions 18 may be connected to an article such as a firearm or luggage either directly or releasably using connectors. In other embodiments, the strap portions 18 may be connected to the bottom of pad portion 20. Additional attachment points for attaching to an article may also be connected to the bottom of the pad portion. One can appreciate that a wide variety of attachment points can be envisioned, dependent on what is intended to be carried by the sling. For example, a light-weight target rifle such as a biathlon rifle may be mounted on or attached to the sling differently than a high caliber hunting rifle, and both rifles differently than an article of luggage such as a backpack.

The sling system of this disclosure and particularly the pad portion 20 is not limited to padding the sling proximate to a user's shoulder(s). For example, in some embodiments, the pad portion is configured to be proximate to a portion of a user's back. As described above, a single pad portion can be proximate to a user's body at both shoulders and the upper back.

Figure 6A:
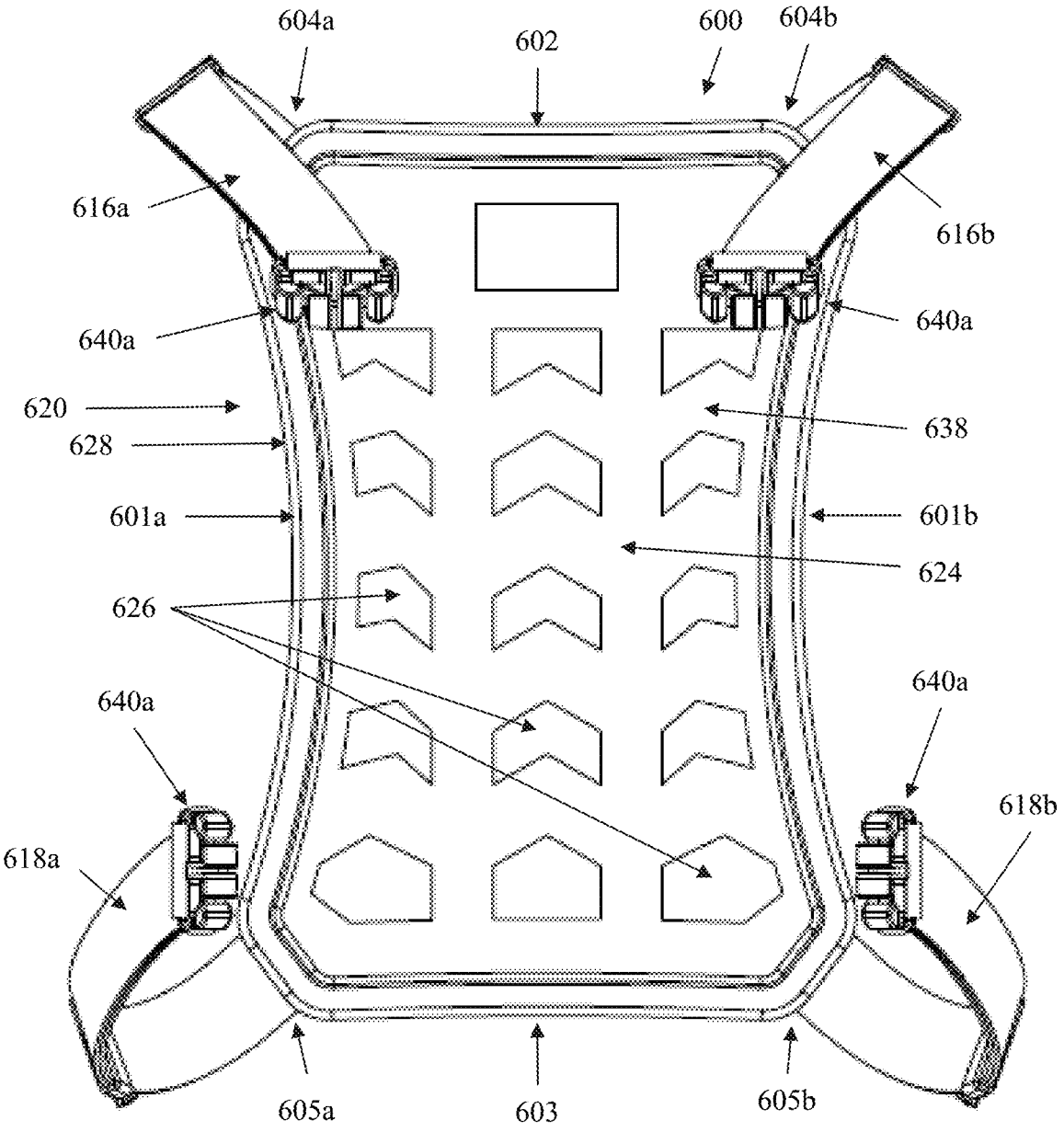
FIGS. 6A, 6B and 6C illustrate views of a backpanel for a sling system, in accordance with an exemplary embodiment of the disclosed subject matter.
Figure 6B:
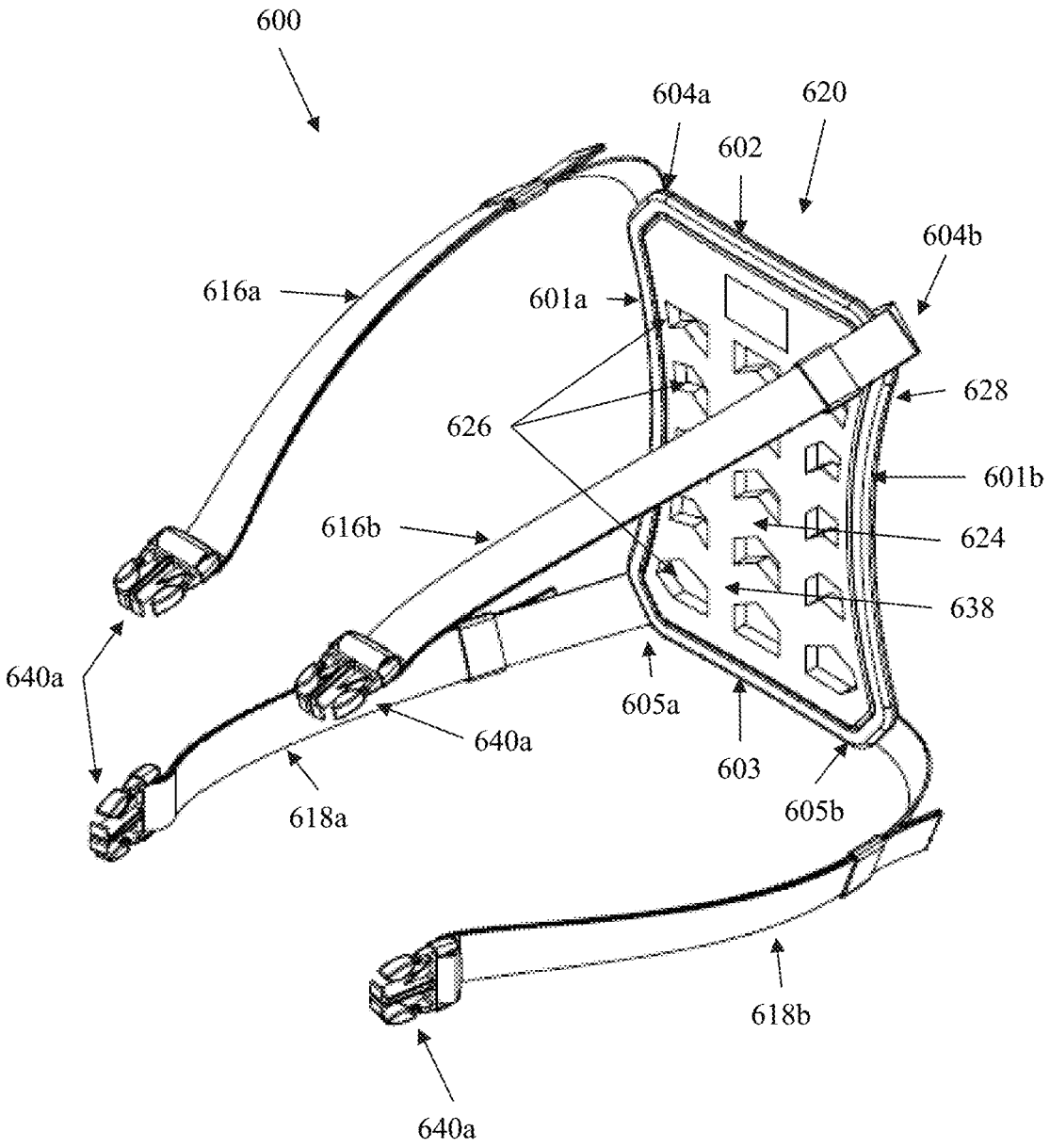
Figure 6C:
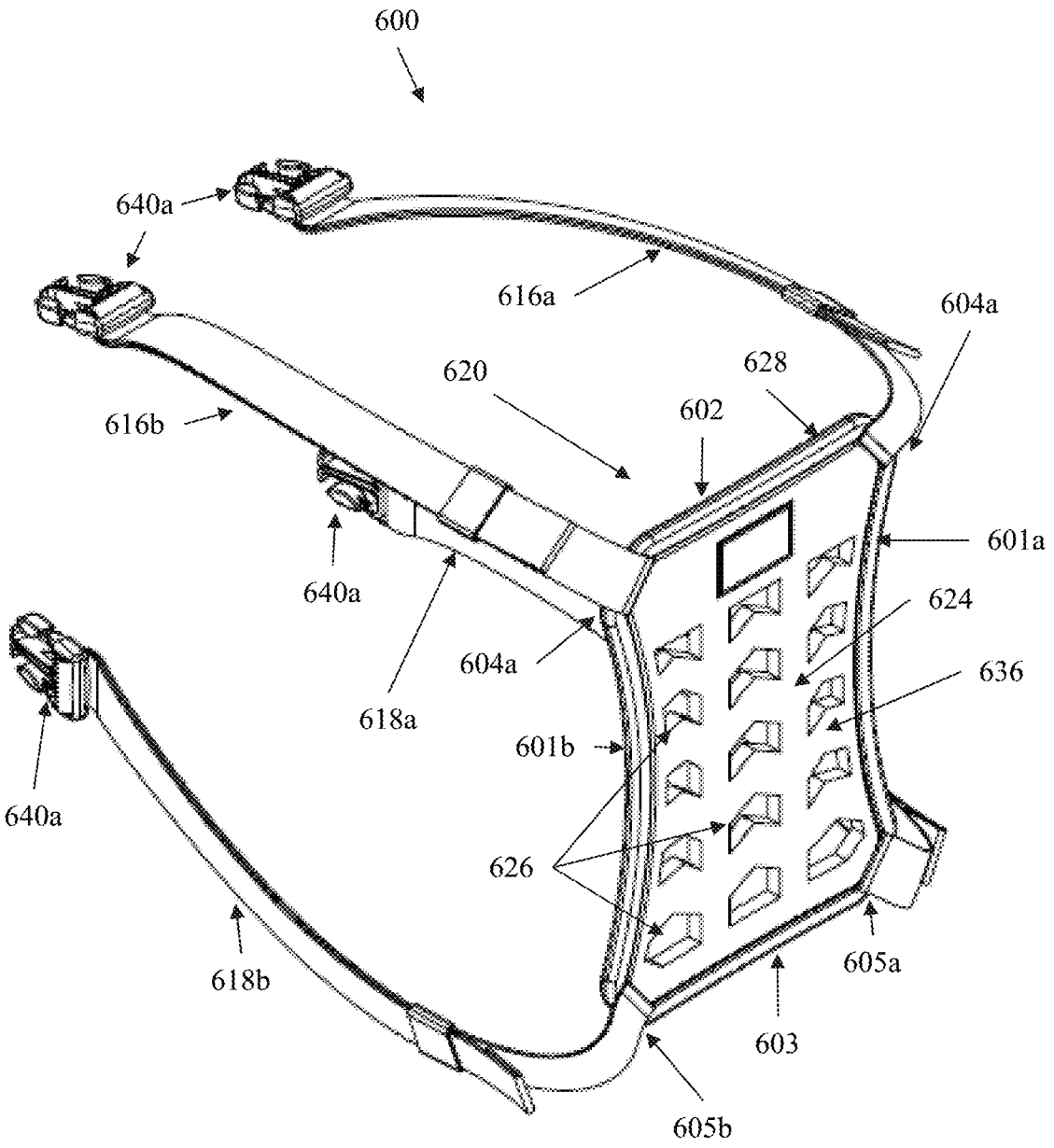

In the embodiment shown in FIGS. 6A-6C, the pad portion is configured as a "back panel" that is worn proximate to the user's back. The pad is configured generally as a quadrilateral shape optionally with concave curvature at one or more of the four sides and has four attachment points at the four corners. For example, the quadrilateral shape may be generally square (four equal sides), rectangular (two opposed sides having a first length and the other two opposed sides having a second length) or trapezoidal (one pair of opposed sides having a first length and the remaining sides having a second length and a third length respectively). Concave curvature of the sides may be at all four sides, or curved at opposed pairs of sides. In the embodiment shown in FIGS. 6A-6C, the top and bottom sides are not curved and the lateral sides have symmetrical concave curvature.

More particularly, the invention provides a back panel for a sling system, comprising a pad comprising a single layer closed cell foam body defining a first surface and a second surface and a plurality of slots extending therethrough from the first surface to the second surface; and a binding secured to the periphery of the pad, wherein the pad configured generally as a quadrilateral shape with four corners and four sides each independently optionally having concave curvature; and four strap portions, each strap portion connected to the pad at one of the four corners, each strap portion comprising a coupling mechanism for connecting the back panel to an article.

FIG. 6A shows a view of the second surface of a back panel 600. FIG. 6B shows a front isometric view of the back panel 600 showing the first surface. FIG. 6C shows a rear isometric view of the back panel 600 showing the second surface of the back panel. The first surface is the surface of the pad that faces away from a user when using the back panel and the second surface paces toward a user when using the back panel. In the embodiment of the back panel shown in these Figures, the back panel 600 comprises a pad portion 620 comprising a pad body 624. The pad portion 620 provides a comfortable fit against the wearer's body when wearing the back panel 600 and absorbs vibrations or shock transferred from a firearm or luggage attached to the back panel 600.

In the embodiment of the back panel shown in these Figures, the back panel 600 comprises a generally rectangular shape with one pair of opposed sides 601*a* and 601*b* having a concave curvature and the top side 602 and bottom side 603 comprising generally straight sides. The upper corners 604*a* and 604*b* and lower corners 605*a* and 605*b* are configured to provide attachment points for attaching the back panel 600 to another article such as a chest pack described hereinbelow. The upper corners 604*a* and 604*b* comprise flexible straps 616*a* and 616*b* respectively. The lower corners 605*a* and 605*b* comprise straps 618*a* and 618*b* respectively. The straps are depicted as they would appear when worn by a user. Straps 616*a*, 616*b*, straps 618*c* and 618*d*, or straps 616*a*, 616*b*, 618*c* and 618*d* may each comprise a length adjustment mechanism to lengthen or shorten the length of the strap to fit a wearer better. The length adjustment mechanism may comprise threading the strap through slot(s) in a buckle so that the effective length of the strap can be adjusted by changing the amount of the free end of the strap extending from the buckle. In the embodiment shown, the length of each of straps 616*a*, 616*b*, 618*c* and 618*d* is adjustable by threading the strap through slots in a male end 640*a* of a side release buckle. This embodiment is not limiting. For example, female ends of a side release buckle may be used instead of the male ends illustrated. Alternatively the length adjustment mechanism is similar to that illustrated in FIG. 5, in which short strap portions are sewn to the pad portion 620, which support buckles similar to buckle 22 of FIG. 5 that allow for the adjustability of the length of the straps 616*a*, 616*b*, 618*c* and/or 618*d*. In still other embodiments, the short strap portion is connected to a male or female end of a side release buckle and the length adjustment mechanism is embodied in another strap portion connected to the short strap portion using a complementary end of the side release buckle.

In some embodiments, the pad body 624 is fabricated from a single layer of closed cell foam material, such as an ethylene-vinyl acetate (EVA) copolymer. The dimensions of the pad body 624 may be varied, provided the pad body 624 is configured to allow the firearm or luggage to be carried on the user's body and provide sufficient comfort to the user.

The pad portion 620 defines one or more slots 626 in the pad body 624. The slots 626 extend from the first surface 636 of the pad body 624 to the second surface 638 thereof. The slots 626 are sized and configured to allow air to pass therethrough and to release heat and moisture from the wearer's body, and to reduce density and weight of the pad body 624. The slots 626 may be formed in a chevron, rectangular, polygonal, circular, oval or other shape, or combinations thereof.

In embodiments, the pad portion 620 further includes a piping or binding 628 that is secured about the perimeter of the pad body 624. In some embodiments, the binding 628 is stitched to the pad body 624. Alternatively, the binding 628 is glued or stapled to the pad body 624. The binding 628 is fabricated from a durable flexible material such as nylon fabric or the like, and provides additional strength to the pad portion 620.

In some embodiments, the pad body 624 is exposed, such that the foam material is not covered with any further materials, and thus is capable of making contact with the wearer. The exposed foam material provides a frictional surface to reduce slipping of the pad portion 620 on the wearer's back. A textured surface, e.g., small dimples, is provided to the upper surface 636 and the lower surface 638 of the pad body 624 to further reduce slipping and provide additional breathability.

In some embodiments, at least a portion of the pad body 624 may be overlaid with a fabric cover over the first surface of the back panel 600 to provide additional strength, modify its appearance or provide additional functionality. Preferably, the fabric cover is lightweight and comprises a textile that is breathable, or permeable to moisture and air, for managing heat and moisture under the pad. In some embodiments, the fabric cover may be fixedly attached to the back panel 600, such as being sewn, glued or stapled into piping or binding 628. In embodiments wherein the back panel 600 is used to carry luggage, the fabric cover may comprise fabric that is the same as that used in at least a portion of the body of the luggage. In other embodiments, the fabric cover may be removably attached to the back panel 600 with fastener(s) such as clips, snaps, buttons, or hook and loop surfaces (e.g. Velcro®). Removable covers may be desirable to modify the appearance of the back panel, depending on its intended use. For example, a removable cover may be used selectively to increase a user's visibility, using a vivid color (e.g. blaze orange) and/or reflective materials, or decrease a user's visibility, such as camouflage patterns selected according to the environment in which the back panel 600 is to be used.

Attachment points in addition to the four attachment points shown in FIGS. 6A-6C may be included. For example, a back panel configured according to an embodiment may comprise an attachment point positioned proximate to the center of the top side 602, i.e. proximate to the center of a user's upper back, for attaching to an article such as a firearm. In other embodiments, additional attachment points may be positioned on the pad portion proximate to the user's shoulders, either at corners 604*a* and 604*b* and/or along top side 602, such as for attaching a backpack to the back panel. Additional attachment points for attaching to an article may also be connected to the bottom of the pad portion, either at corners 605*a* and 605*b* and/or along bottom side 603. One can appreciate that a wide variety of attachment points can be envisioned, dependent on what is intended to be carried by the back panel.

The back panel, such as shown in FIGS. 6A-6C, may comprise a foundation for a variety of padded harness configurations.

In embodiments, the back panel can be attached at the four attachment points to two slings or shoulder straps 10 of the configuration shown in FIGS. 1-5 to provide pad areas for the shoulders and upper back of a user. Strap portions 16 of the sling can be attached to upper attachment points at corners 604*a* and 604*b* of the back panel directly or they can be releasably connected, for example by using side release buckles. Strap portions 18 can be adjustably attached to the lower attachment points at corners 605*a* and 605*b* of the back panel. This configuration with three pad portions 20 may be more adjustable and comfortable than that provided by a single pad portion 20. This configuration can be attached to a firearm or luggage article as previously described.

Figure 7:
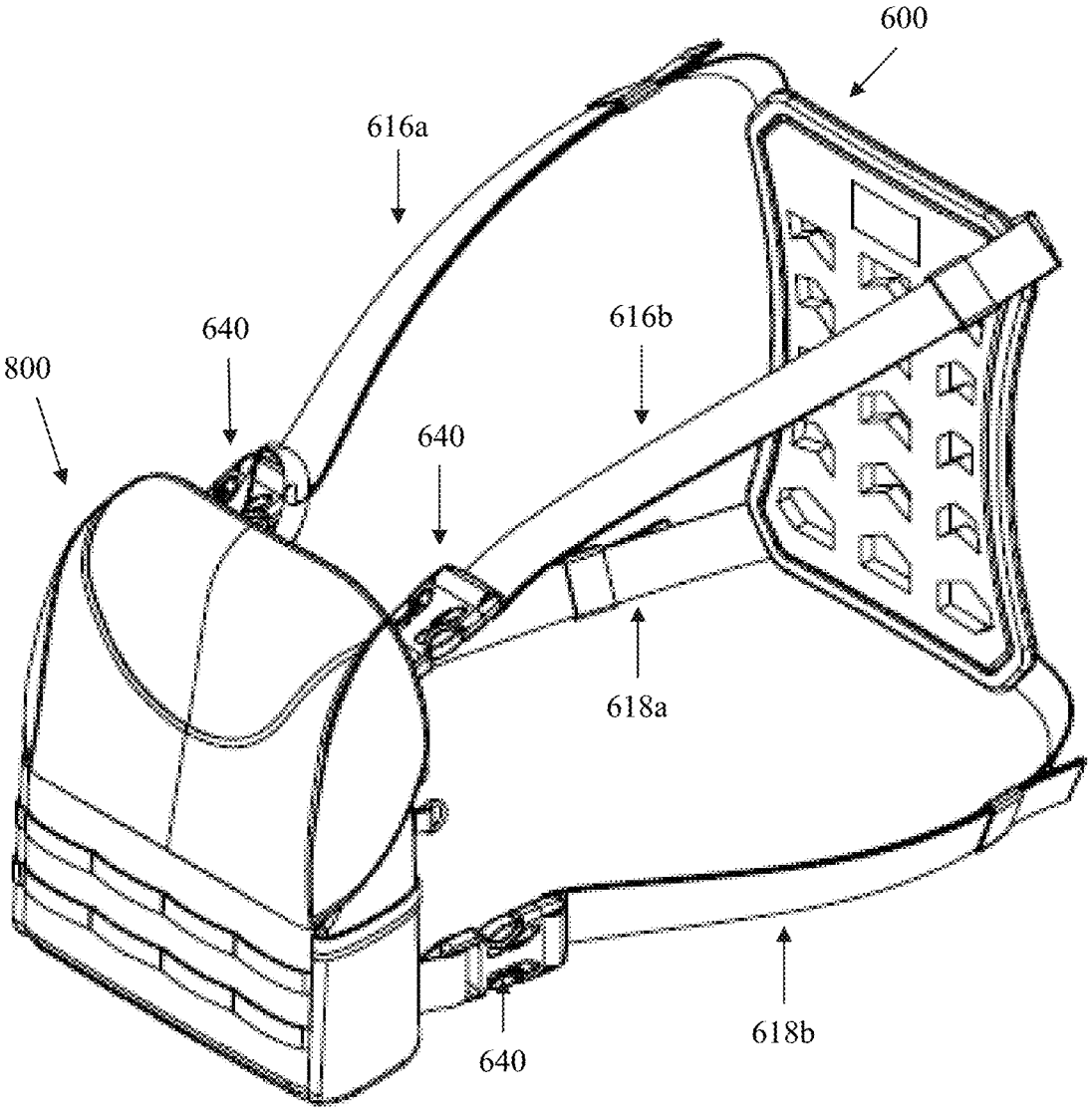
FIG. 7 illustrates an isometric view of the backpanel of FIGS. 6A-6C releasably attached to a chest pack, in accordance with an exemplary embodiment of the disclosed subject matter.

In embodiments, the back panel 600 may be attached at the four corner attachment points to a chest pack 800 to be worn by a user, as shown in FIG. 7. Straps at the top of the chest pack 800 are releasably connected to the upper attachment points of the back panel. Straps at the lower portion of the chest pack 800 are releasably connected to the lower attachment points of the back panel. Quick release buckles, such as side release buckles 640, on the strap portions allow easy removal of the case from the back panel. In the embodiment shown, strap portions on the chest pack comprise female components of side release buckles and strap portions on the back panel comprise complementary male components of side release buckles. In the embodiment shown, straps 616*a*, 616*b*, 618*c* and 618*d* are releasably connected to the chest pack 800 using female ends of the side release buckles attached to the chest pack releasably connected the male ends 640*a* of side release buckles 640 connected to. The illustrated buckles are not limiting. For example, alternatively the strap portions on the chest pack comprise male components of side release buckles and strap portions on the back panel comprise complementary female components of side release buckles. In the embodiment shown, straps 616*a*, 616*b*, 618*c* and 618*d* comprise male ends 640*a* of side release buckles and length adjustment mechanisms as previously described, but this is not limiting. Alternatively, straps 616*a* and 616*b*, and/or straps 618*c* and 618*d* comprise short, fixed lengths and corresponding straps on the chest pack 800 comprise the length adjustment mechanisms.

Figure 8A:
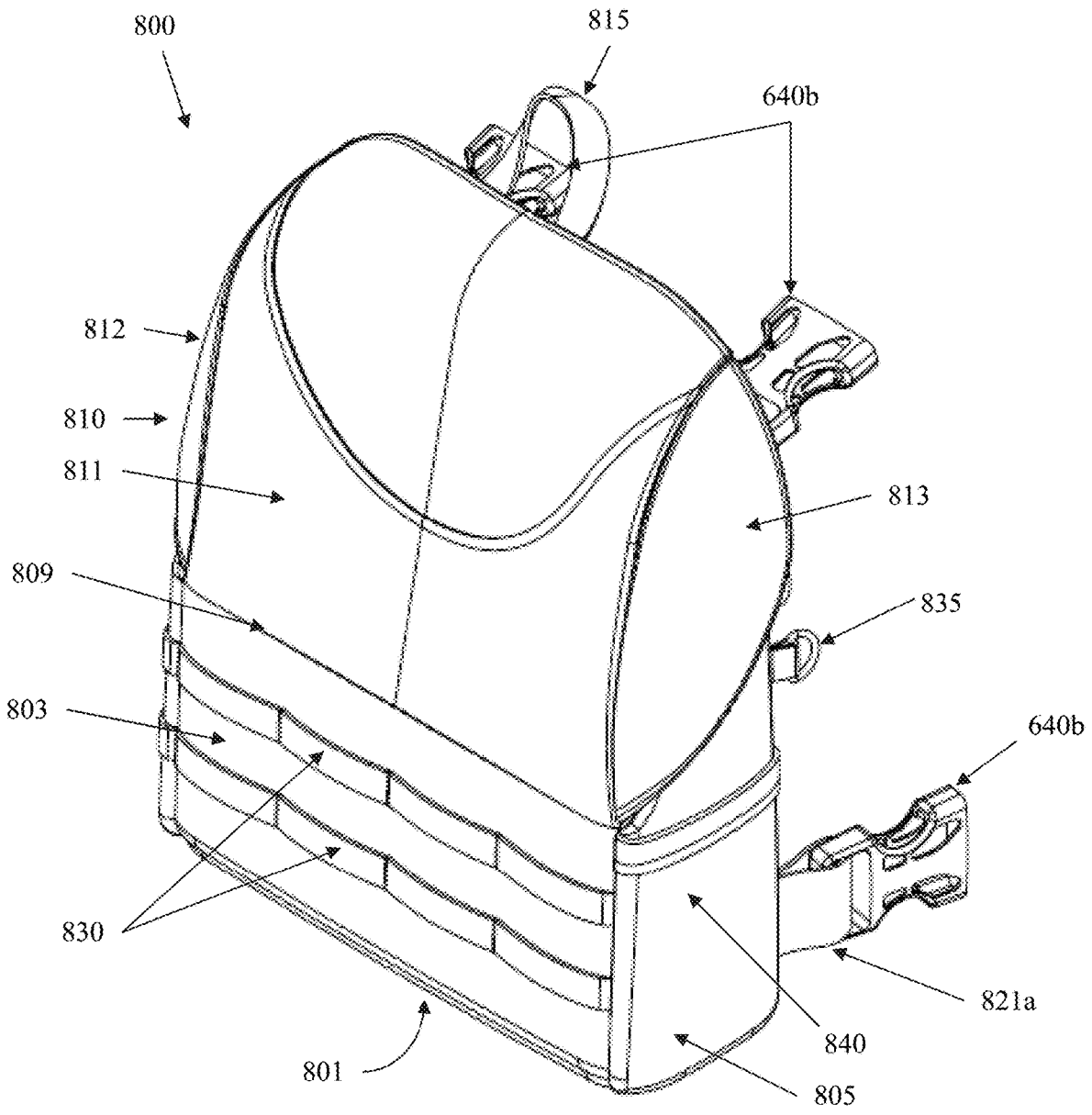
FIG. 8A illustrates a front isometric view of a chest pack, in accordance with an exemplary embodiment of the disclosed subject matter.
Figure 8B:
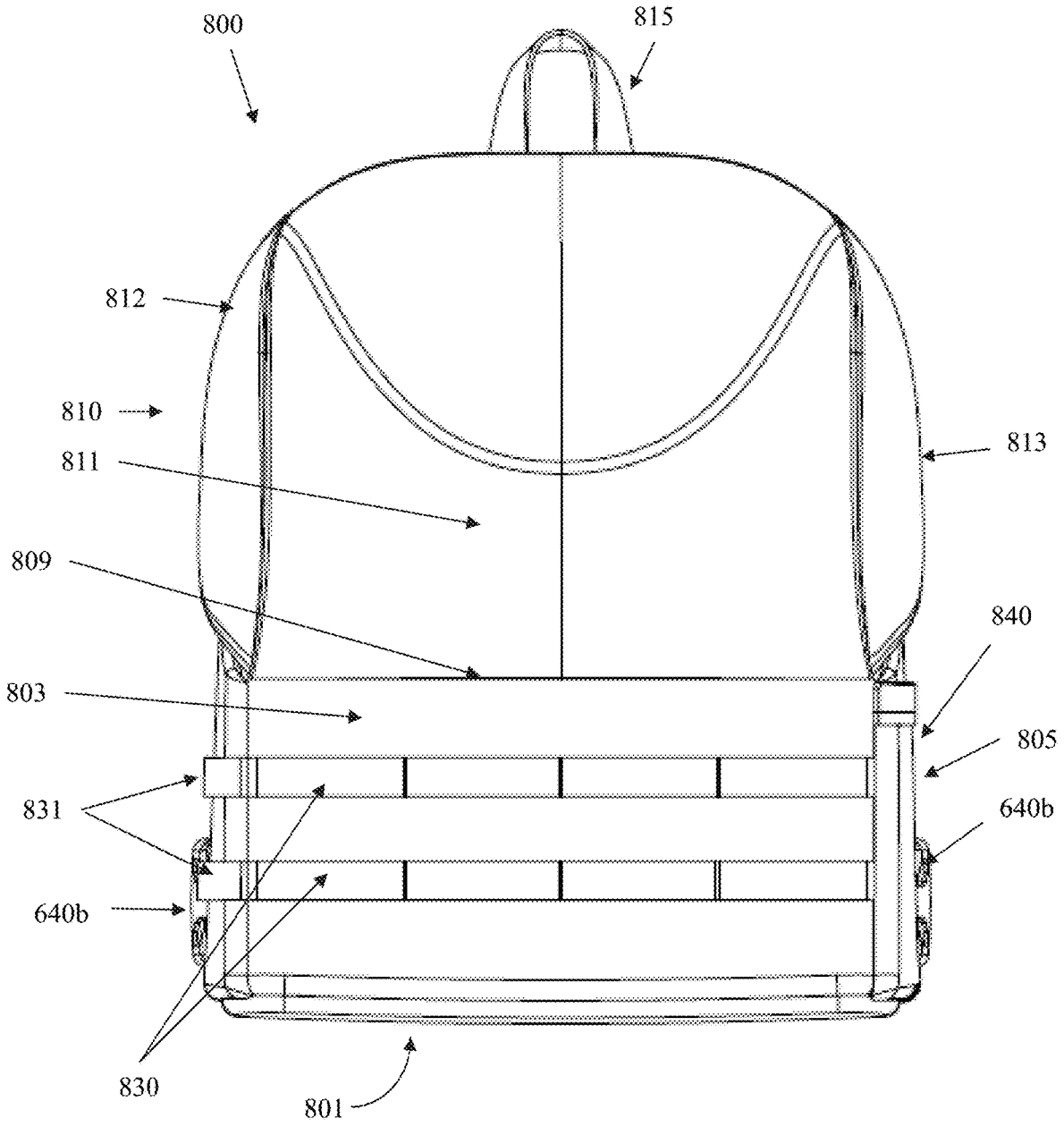
FIG. 8B illustrates a front view of a chest pack, in accordance with an exemplary embodiment of the disclosed subject matter.
Figure 8C:
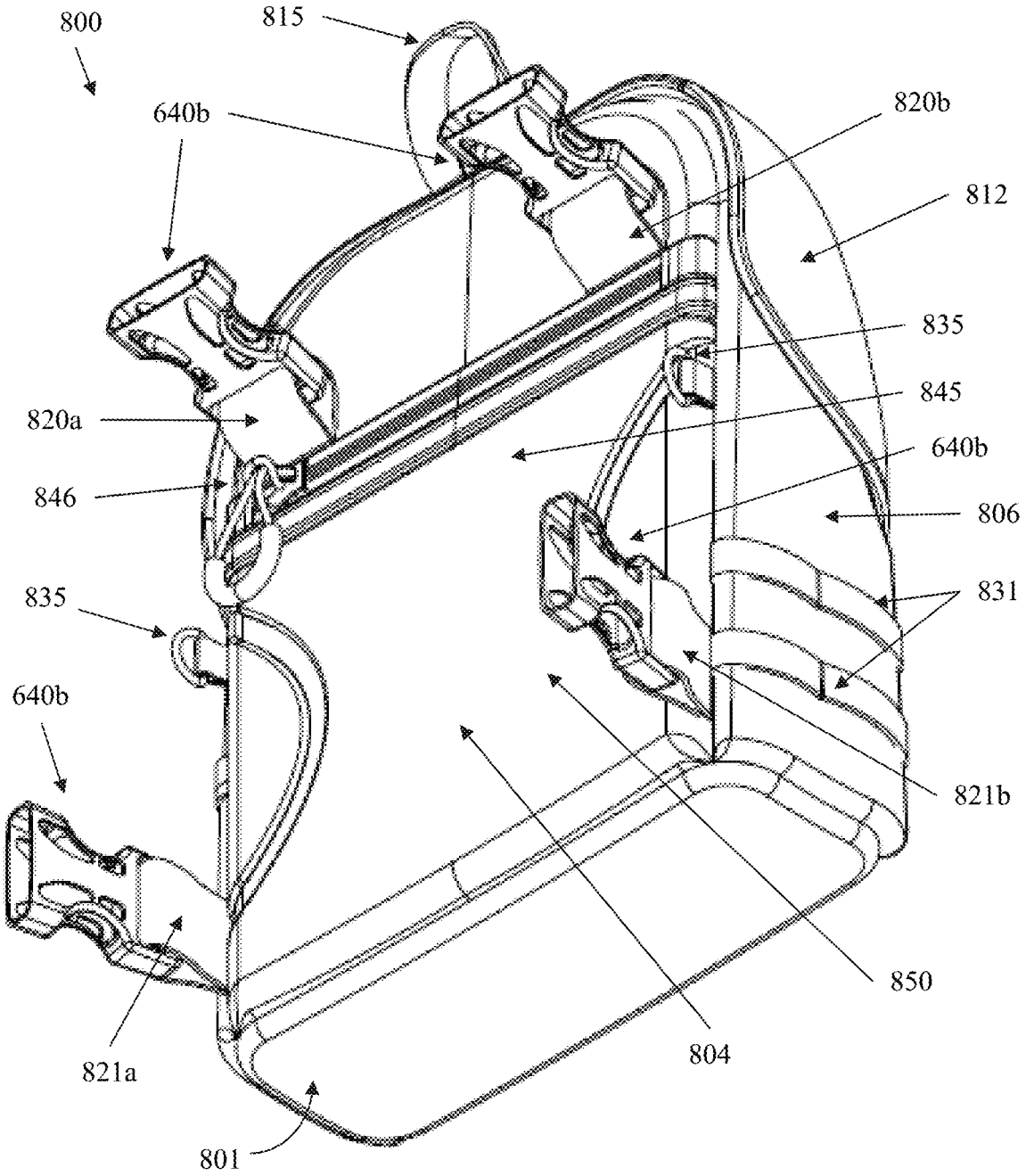
FIG. 8C illustrates a rear isometric view of a chest pack, in accordance with an exemplary embodiment of the disclosed subject matter.
Figure 8D:
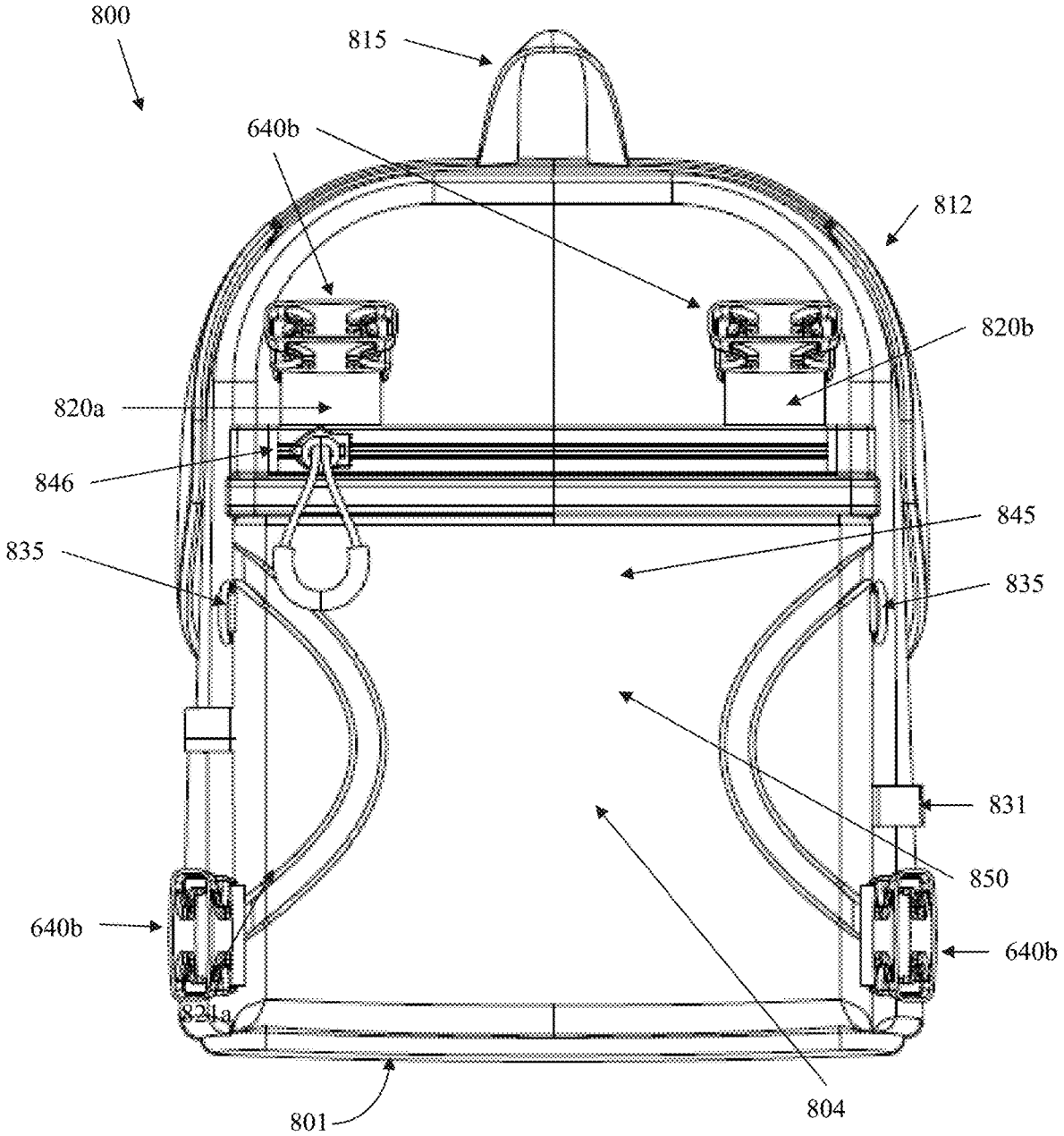
FIG. 8D illustrates a rear view of a chest pack, in accordance with an exemplary embodiment of the disclosed subject matter.
Figure 8E:
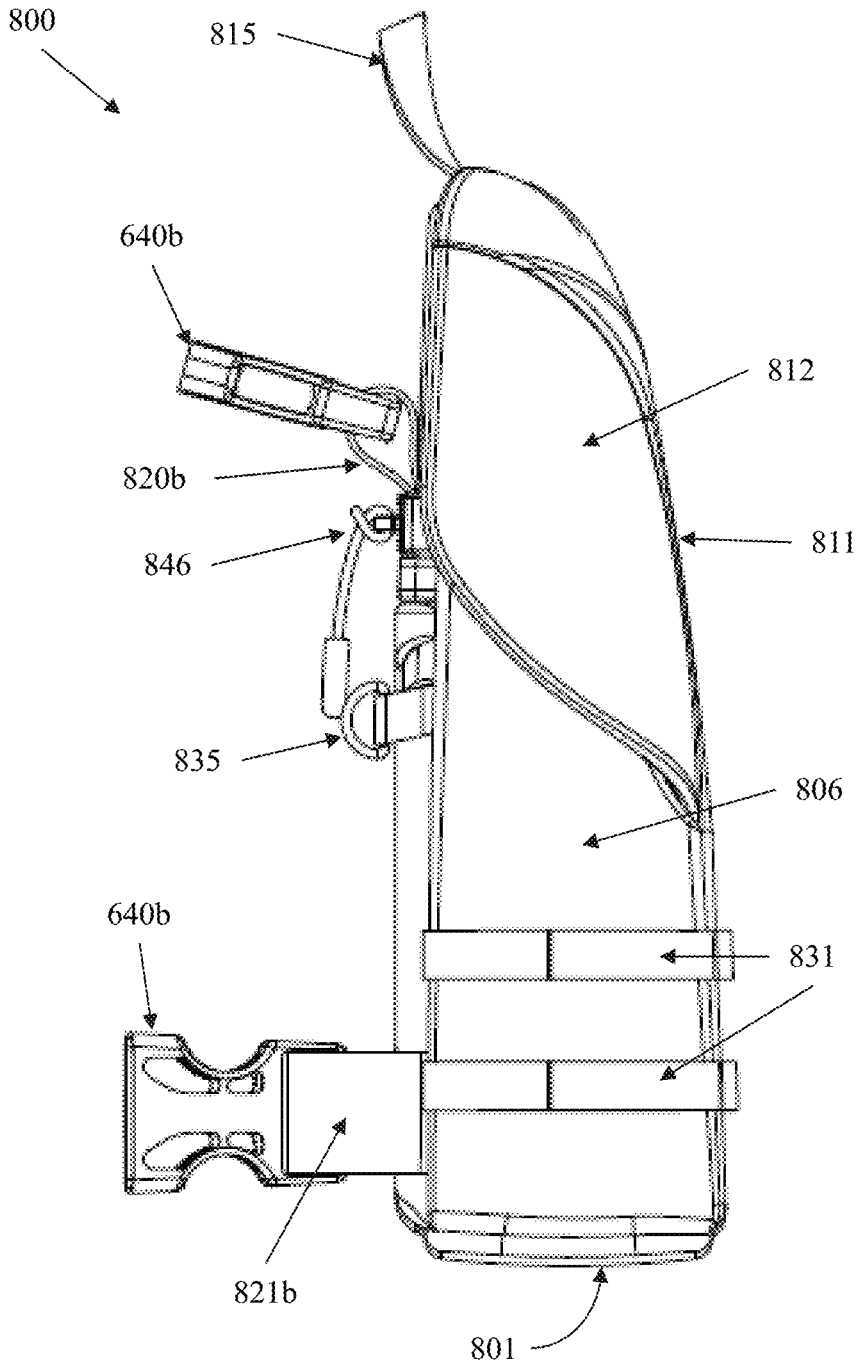
FIG. 8E illustrates a side view of a chest pack, in accordance with an exemplary embodiment of the disclosed subject matter.
Figure 8F:
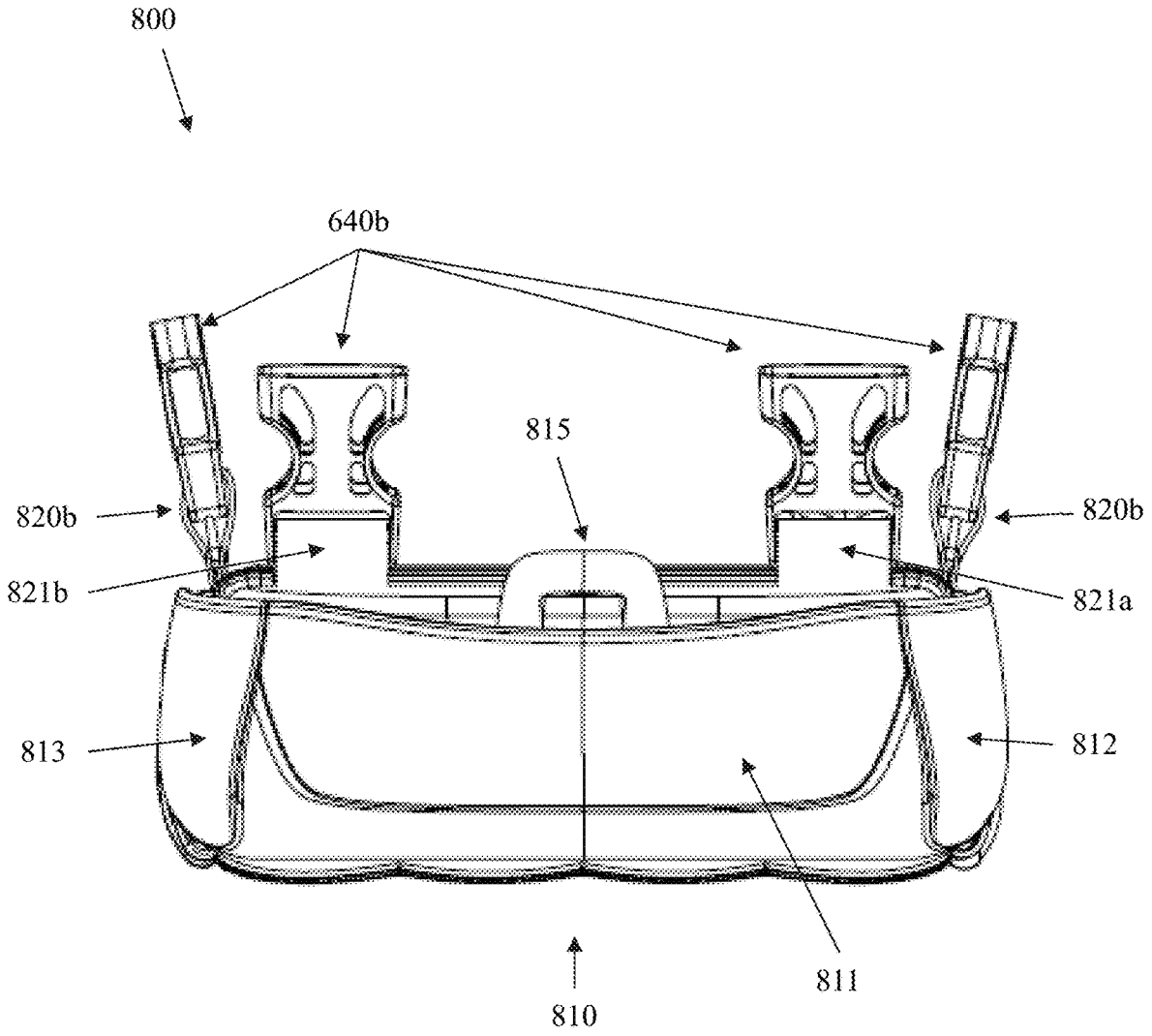
FIG. 8F illustrates a top view of a chest pack, in accordance with an exemplary embodiment of the disclosed subject matter.
Figure 9A:
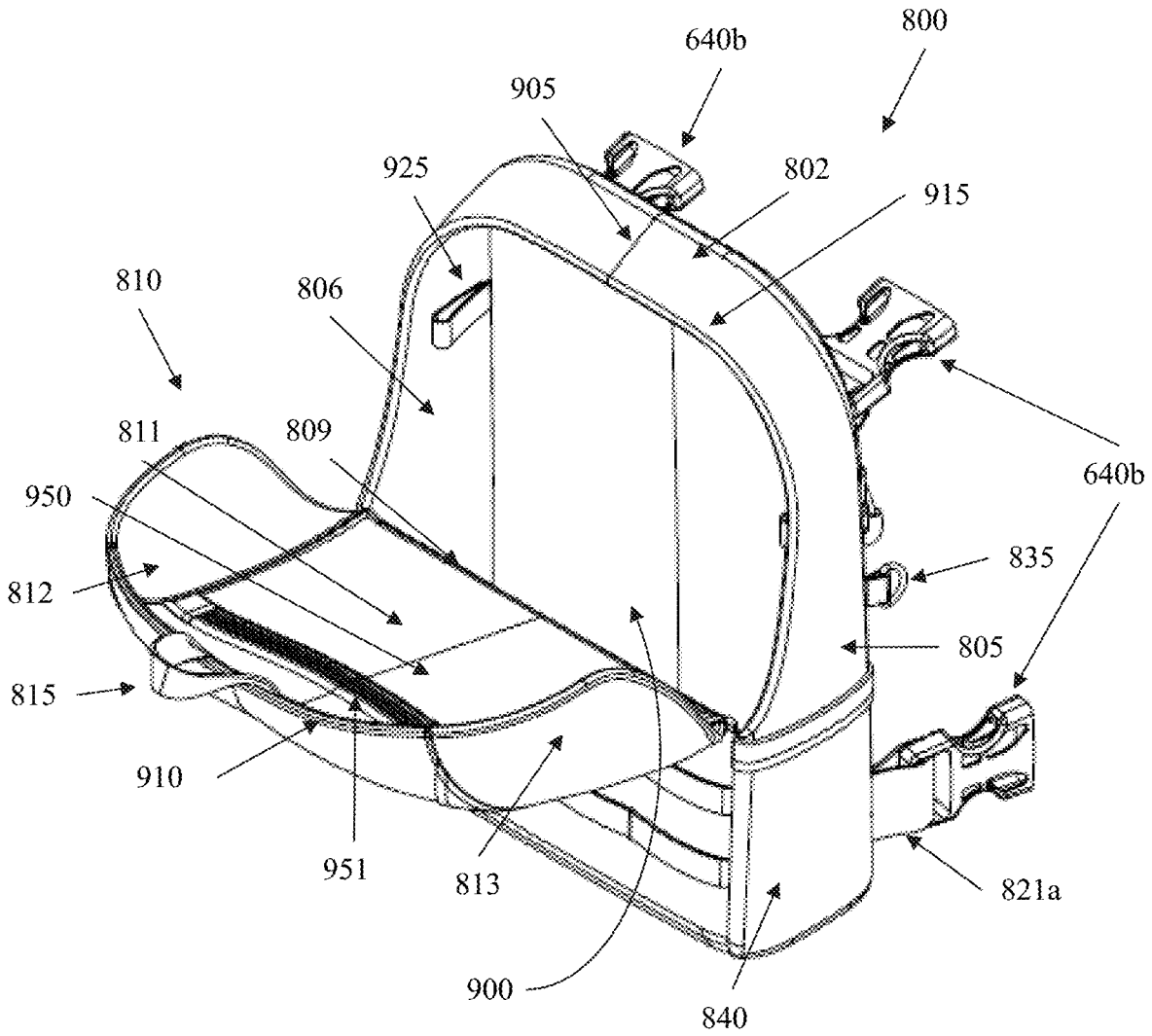
FIG. 9A illustrates a top isometric view of a chest pack with the cover flap in the open configuration, in accordance with an exemplary embodiment of the disclosed subject matter.
Figure 9B:
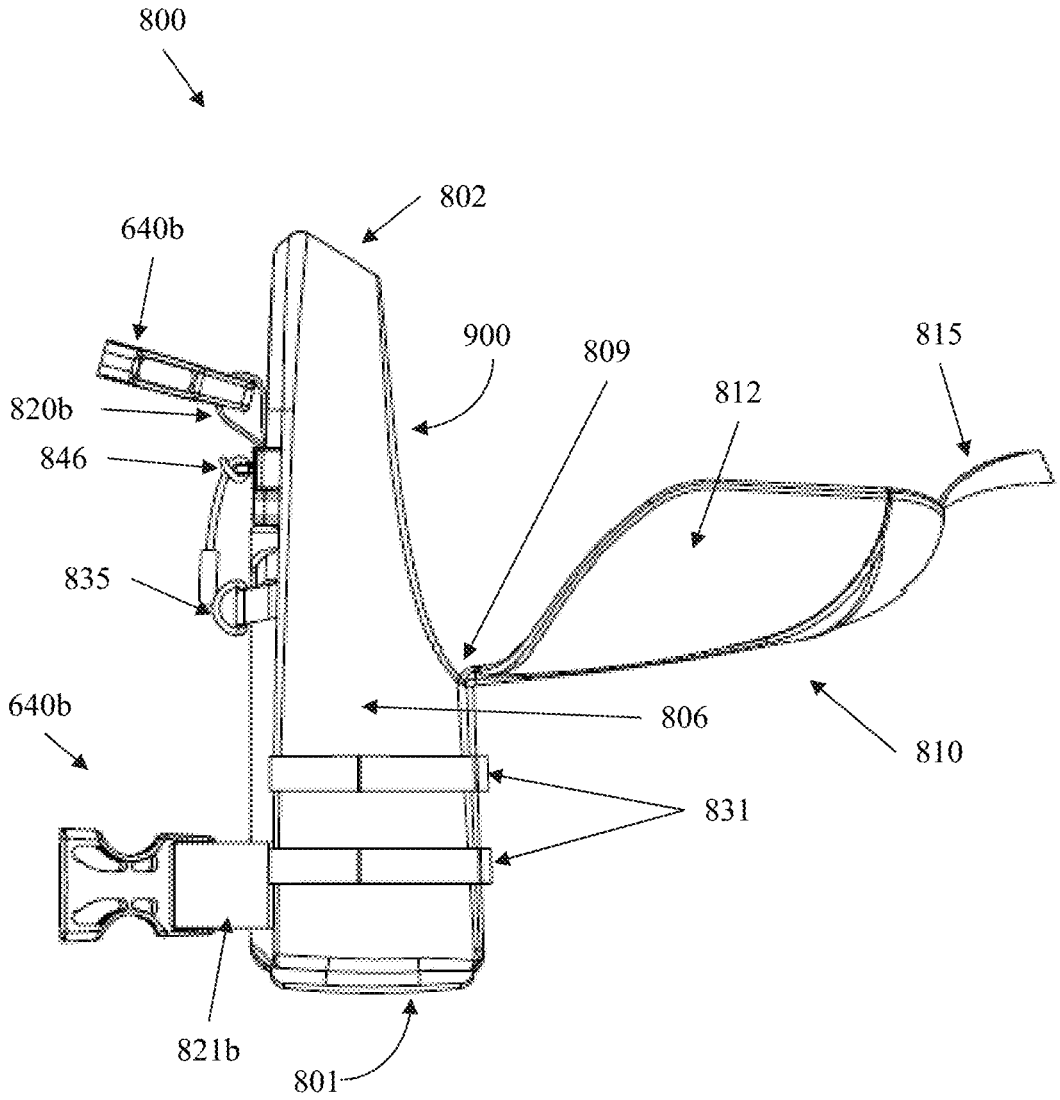
FIG. 9B illustrates a side view of a chest pack with the cover flap in the open configuration, in accordance with an exemplary embodiment of the disclosed subject matter.

A specific embodiment of a chest pack 800 comprising a case for holding an optical device such as a binocular, range finder, camera, telescope, monocular and/or lens is shown in FIGS. 8A-8F, 9A and 9B. FIGS. 8A-8F show the chest pack or case 800 in a closed configuration and FIGS. 9A and 9B show the chest pack or case 800 in an open configuration. FIG. 8A illustrates a front isometric view of the chest pack 800. FIG. 8B illustrates a front view of the chest pack 800. FIG. 8C illustrates a rear isometric view of the chest pack 800. FIG. 8D illustrates a rear view of the chest pack 800. FIG. 8E illustrates a side view of a chest pack 800. FIG. 8F illustrates a top view of the chest pack 800.

The case 800 for an optical device comprises a bottom wall 801, top wall 802, front wall 803, back wall 804 and opposing side walls 805 and 806 connected together at their edges to form the body of the case 800 and wherein edges of the top wall 802, front wall 803 and side walls 805 and 806 define an opening into a compartment adapted for receiving the optical device(s), and a cover flap 810 configured to overlap at least a portion of each of the top 802 and side walls 805 and 806 hingedly attached to an edge of the front wall at the intersection of the front wall 803 and the coverflap 810 at locus 809, wherein when the cover flap is in the overlapping or closed configuration completely enclose the optical device in the compartment to protect it from dust, debris and the elements.

The cover flap 810 comprises a magnet or plurality of magnets (not shown) to automatically engage complementary ferromagnetic components such as iron-containing plate (s), strip(s) or magnet(s) on the top and side walls (not shown) to hold the cover flap in an overlapping configuration that covers the opening into the compartment. The cover flap is rotatable forwardly at the hinge area 809 to expose the opening to access or stow the optical device(s). In the embodiment shown in the Figures, the cover flap 810 comprises a front wall 811 connected to opposed side walls 812 and 813 to define a half-arched cross-sectional shape at the top of case 800, as best seen in FIGS. 8A and 8E. Also in the embodiments shown, the front wall 803, back wall 804 and cover flap 810 of the case 800 are configured to taper inward so that the case is narrower at the top than at the bottom, as best seen in FIGS. 8B and 8D. However, this shape is not limiting. A loop 815 may be included on the cover flap 810 to facilitate efficient one-handed opening.

Preferably, the bottom wall 801, top wall 802, front wall 803, back wall 804, opposing side walls 805 and 806 and cover flap 810 are made of one or more flexible materials. The body of the case may comprise suede cloth and optional padding on the walls and cover flap. Optionally, the bottom wall 801 may further comprise a stiffening element comprising a generally rectangular plate comprising a semi-rigid or rigid material.

The case 800 comprises connectors to releasably attach the case 800 to the back panel 600, such as is shown in FIG. 7. In the embodiment shown in FIGS. 8A-8F, the connectors comprise female ends 640*b* of side release buckles that engage complementary male ends 640*a* on the backpanel 600. The female ends 640*b* are attached to the case 800 using short strap loops 820*a* and 820*b*, and 821*a* and 821*b* at the top and bottom of the case 800, respectively. As discussed above, this is not limiting and other connectors are envisioned.

Other optional features may include MOLLE (Modular Light-weight Load-carrying Equipment) webbing comprising a plurality of fabric straps 830 on the front wall 803 and/or a plurality of fabric straps 831 on side walls (e.g. side wall 806) and/or D-ring(s) 835 to attach accessories to the exterior of the case, and/or fabric or mesh pocket(s) 840 on the front wall below hinge 809 and/or one or both of the side walls 805 and 806. As shown in the Figures, a pocket 840 is disposed on side wall 805.

As shown in FIGS. 8C and 8D, the back wall 802 may comprise an optional exterior compartment or pocket 845 with a zipper closure 846. The back wall 802 may optionally comprise an airmesh surface or a pad having a similar construction as pad body 20 or 620 at area 850 for breathability. These features are not limiting.

Figure 9C:
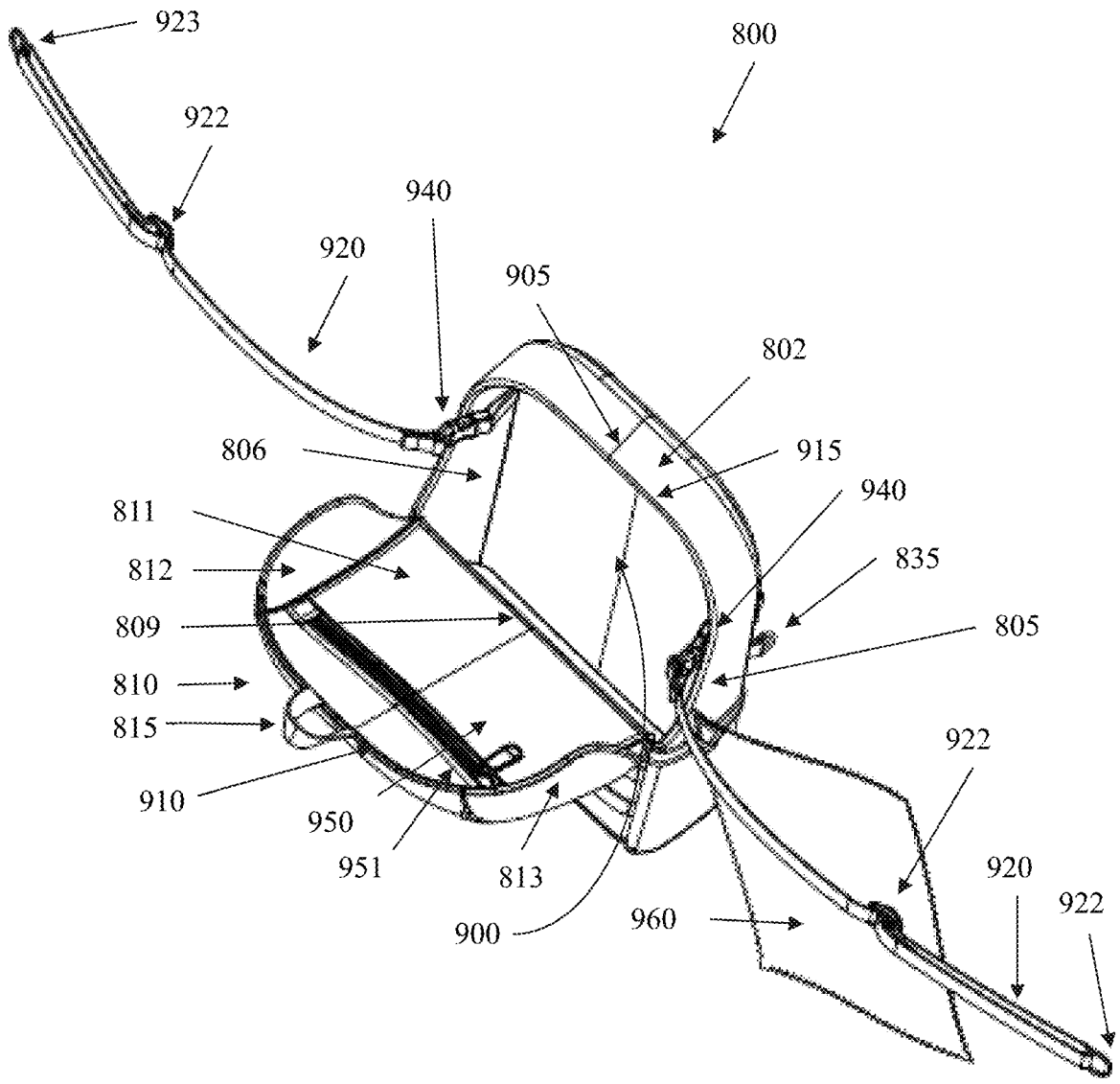
FIG. 9C illustrates a top isometric view of a chest pack with the cover flap in the open configuration to show optional interior features, in accordance with an exemplary embodiment of the disclosed subject matter.

FIGS. 9A-9C show the case 800 wherein cover flap 810 is in the open configuration for a user to access the internal compartment 900. In the embodiment shown, side walls 805 and 806 extend into the top of the case 800 and are seamed together at seam 905 to form top wall 802. In alternative embodiments, opposed ends of the top wall 802 may be connected to sidewalls 805 and 806.

In the embodiments shown, the hinge area 809 is configured so that the cover flap is rotated downward about 90° from its closed configuration to its open configuration (compare FIGS. 8E and 9B). In the open configuration, the inside surface of the front wall 811 of the cover flap 810 can function as a shelf to rest objects on. Optionally, the pack 800 may comprise fabric gussets connecting side walls 805 and 806 of the main body of the case to side walls 812 and 813, respectively, of the cover flap 810 to limit the rotation of the cover flap downward.

The cover flap 810 comprises a magnet or plurality of magnets (not shown) along edge 910 to automatically engage complementary ferromagnetic components such as iron-containing plate(s) or strips(s) or magnet(s) (not shown) at the edge 915 of the top and/or side walls to hold the cover flap 810 in an overlapping configuration that covers the opening into the compartment. The magnets and ferromagnetic components are covered with fabric to provide a quiet closure and are not visible in the Figures.

Inside the compartment 900, the case 800 optionally may comprise tether(s) 920 to releasably attach the optical device to the case. The tethers 920 have a length adjustment mechanism similar to that shown in FIG. 5 using buckles 922. The tethers may be releasably connected to an optical device such as binoculars using split rings 923. The tethers may be releasably connected to the interior of the case using side release buckles 940, similar to side release buckles 640. Optionally, the case comprises an interior mesh pocket 950, optionally with a closure such as a zipper 951, for containing small articles such as lens cloth, tool kit, cell phone, etc. In the embodiment shown, the compartment 900 is sized to contain a 10×42 roof prism binocular, but this is for example and not limitation. Another optional feature is a microfiber cloth 960 for a lens wipe, which may be attached to the interior of the case by a short elastic strap (not shown). One can appreciate that the optional tethers 920 and lens wipe 960 are shown fully extended from the compartment 900, but they would normally be stowed inside the compartment unless they are being used.

Optionally, embodiments of a front pack described herein may comprise an additional lower compartment disposed on the bottom wall 801 formed by extending the front wall 803, back wall 804 and side walls 805 and 806 to connect with a second bottom wall to define the lower compartment. The lower compartment can be accessed using an opening in the front wall 803 and optionally side walls 805 and 806 wherein the second bottom wall is hingedly attached to the back wall 804. The opening can be closed using a zipper, a magnetic closure system, complementary hook and loop surfaces, or other closures. Fabric gussets attached to the side walls 805 and 806 above and below the opening can limit the amount the second bottom wall can rotate downward when opened.

In some embodiments, the pad portion 20 may be configured as a belt to be worn around a user's waist and/or hips. Straps 32 and buckles 22 are attached to both ends of the pad portion 20 and strap portions 18 are adjustably connected thereto so that the length of the belt can be customized to a user. The ends of strap portions 18 are attached to complementary components of a belt buckle such as a side release buckle. The belt can comprise a plurality of attachment points for attaching accessories that can hold small items that can be accessed without removal of the belt. Such accessories may include as pouches for small items such as cell phones, cameras, snacks, ammunition and the like, holsters for handguns, sheathes for knives, hangers for tools, water containers, etc. The belt can be customized depending on its intended purpose. For example, the belt can be accessorized as a hip pack for day trips, a belt for carrying items for a hunting trip, or a tool belt for carpenters, electricians and other tradesmen. The belt can also be configured to provide additional support for large backpacks.

In some embodiments, a belt according to the above can be combined with two slings to provide a carrying harness where the weight is distributed among the hips and shoulders.

In some embodiments the back panel and/or slings of this disclosure may be used in conjunction with a conventional backpack to provide additional padding and moisture control. For example, a back panel may be attached to a conventional backpack so that it is positioned between the backpack and a user when worn. Pad portions 20 can be configured to be added to shoulder straps of a conventional backpack to provide additional padding. In some embodiments a back panel and two shoulder straps can be combined to provide a padded harness or "garment" that can be worn under a conventional backpack for padding and moisture control.

In some embodiments a back panel and two shoulder straps can be combined to provide a padded multipurpose harness that can be selectively and interchangeably equipped with different accessories depending on a user's needs. For example, a user may use the harness to attach a detachable firearm hanger, a chest pack for an optical device, and a small day pack for a hunting trip. A hip belt may be used to carry additional small items. Alternatively, the harness may be configured with a larger backpack for backpack camping trips. A hip belt can be attached to the backpack to provide additional carrying support.

Descriptions of embodiments of the invention in the present application are provided by way of example and are not intended to limit the scope of the invention. The described embodiments comprise different features, not all of which are required in all embodiments of the invention. Some embodiments utilize only some of the features or possible combinations of the features. Variations of embodiments of the invention that are described, and embodiments of the invention comprising different combinations of features noted in the described embodiments, will occur to persons of the art. The scope of the invention is limited only by the claims.

What is claimed is:

1. A pack to be worn proximate to a user's chest, comprising:

two strap portions at the top of the pack and two strap portions at the bottom of the pack;

a compartment for holding an optical device, the compartment comprising a bottom wall, top wall, back wall, front wall and opposing side walls wherein the edges of the top wall, front wall and side walls define an opening into the compartment, and a cover flap configured to overlap at least a portion of each of the top and side walls hingedly attached to a hinge area at the edge of the front wall to completely enclose the optical device when closed and rotatable forwardly at the hinge area to expose the opening to access the optical device; and one or more tethers, each comprising a first end releasably connected inside the compartment and a second end configured to releasably connect to a body of the optical device; and a back panel to be worn proximate to a user's back comprising a pad comprising a single layer closed cell foam body defining a first surface and a second surface and a plurality of slots extending therethrough from the first surface to the second surface; and a binding secured to the periphery of the pad, wherein the pad configured generally as a quadrilateral shape with four corners comprising two upper corners and two lower corners and four sides optionally having concave curvature; and four strap portions, each strap portion connected to the pad at one of the four corners, each strap portion comprising a coupling mechanism; wherein a first strap portion at the top of the pack is attached to a first strap portion connected to the pad at one of the two upper corners of the back panel and a second strap portion at the top of the pack is attached to a second strap portion connected to the pad at another of the two upper corners of the back panel, and a first strap portion at the lower portion of the pack is attached to a first strap portion connected to the pad at one of the two lower corners of the back panel and a second strap portion at the lower portion of the pack is attached to a second strap portion connected to the pad at another of the two lower corners of the back panel.

2. The pack of claim 1 wherein the foam body is an ethylene-vinyl acetate copolymer.

3. The pack of claim 1 wherein the first and second surfaces of the pad are exposed.

4. The pack of claim 1 wherein a binding is secured to the periphery of the pad.

5. The pack of claim 1 wherein the two strap portions at the top of the pack comprise a length adjustment mechanism.

6. The pack of claim 1 wherein the two strap portions at the top of the pack comprise female components of side release buckles.

7. The pack of claim 1 wherein the two strap portions at the lower portion of the pack comprise side release buckles.

8. The pack of claim 1 wherein the two strap portions at the lower portion of the pack comprise female components of side release buckles.

9. The pack of claim 1 wherein the optical device is selected from a binocular, range finder, camera or any combination thereof.

10. The pack of claim 1 wherein the cover flap comprises a magnet or plurality of magnets to automatically engage a complementary ferromagnetic surface on the top and side faces to cover the opening.

11. The pack of claim 1 comprising a microfiber cloth attached inside the compartment.

12. The pack of claim 1 comprising an interior mesh pocket.

13. The pack of claim 1 further comprising at least one accessory on the exterior of the pack for attaching or containing an article, the accessory selected from the group consisting of webbing, a pocket on one or more of the front, back and side walls and a D-loop.

14. The pack of claim 1 wherein the back wall comprises an airmesh surface.

15. The pack of claim 1 wherein the compartment is sized to contain a 10×42 roof prism binocular.

16. The pack of claim 1 wherein the body of the pack comprises suede cloth and optional padding on one or more of the walls and cover flap.

* * * * *